US010743677B2

(12) United States Patent
Schmitz et al.

(10) Patent No.: US 10,743,677 B2
(45) Date of Patent: Aug. 18, 2020

(54) ATTACHMENT STRUCTURE FOR SUSPENSION SEATING

(71) Applicant: HERMAN MILLER, INC., Zeeland, MI (US)

(72) Inventors: Johann Burkhard Schmitz, Berlin (DE); Carola Eva Marianne Zwick, Berlin (DE); Roland Rolf Otto Zwick, Berlin (DE); James Slagh, Holland, MI (US); Brent Tracy, Holland, MI (US); Michael D. Stanton, Sr., Rockford, MI (US)

(73) Assignee: HERMAN MILLER, INC., Zeeland, MI (US)

( * ) Notice: Subject to any disclaimer, the term of this patent is extended or adjusted under 35 U.S.C. 154(b) by 70 days.

(21) Appl. No.: 15/739,577

(22) PCT Filed: Jun. 29, 2016

(86) PCT No.: PCT/US2016/040126
§ 371 (c)(1),
(2) Date: Dec. 22, 2017

(87) PCT Pub. No.: WO2017/004224
PCT Pub. Date: Jan. 5, 2017

(65) Prior Publication Data

US 2018/0310721 A1 Nov. 1, 2018

Related U.S. Application Data

(60) Provisional application No. 62/185,932, filed on Jun. 29, 2015, provisional application No. 62/266,200, filed on Dec. 11, 2015.

(51) Int. Cl.
*A47C 31/02* (2006.01)
*A47C 7/28* (2006.01)
(Continued)

(52) U.S. Cl.
CPC ..... *A47C 31/023* (2013.01); *A47C 3/30* (2013.01); *A47C 7/282* (2013.01); *A47C 7/36* (2013.01); *A47C 7/40* (2013.01); *A47C 7/54* (2013.01)

(58) Field of Classification Search
CPC ..... A47C 31/023; A47C 7/282
(Continued)

(56) References Cited

U.S. PATENT DOCUMENTS 3,041,109 A 6/1962 Eames et al.
6,540,950 B1 * 4/2003 Coffield ..... A47C 7/282 156/245
(Continued)

FOREIGN PATENT DOCUMENTS

EP 1552771 A1 7/2005
JP 2011045573 A 3/2011
(Continued)

OTHER PUBLICATIONS

International Search Report and Written Opinion for Application No. PCT/US2016/040126 dated Oct. 4, 2016 (19 pages).
(Continued)

*Primary Examiner* — Joanne Silbermann
(74) *Attorney, Agent, or Firm* — Michael Best & Friedrich LLP

(57) ABSTRACT

A seating structure includes a frame, a carrier, and a suspension material. The frame includes first and second side frame members spaced apart in a first direction and defining an opening therebetween. The first and second side frame members have an inner portion facing the opening and an outer portion facing away from the opening, the outer portion including a plurality of first attachment features facing away from the first and second side frame members in the first direction. The carrier includes first and second
(Continued)

side carrier members. The first and second side carrier members include a plurality of second attachment features facing the first and second side frame members in the first direction, the plurality of second attachment features engaging the plurality of first attachment features to attach the carrier to the frame. The suspension material is attached to the carrier and extends over the opening in the frame.

27 Claims, 19 Drawing Sheets

(51) Int. Cl.

| | |
|---|---|
| ***A47C 3/30*** | (2006.01) |
| ***A47C 7/36*** | (2006.01) |
| ***A47C 7/40*** | (2006.01) |
| ***A47C 7/54*** | (2006.01) |

(58) Field of Classification Search
USPC ..... 297/DIG. 2
See application file for complete search history.

(56) References Cited

U.S. PATENT DOCUMENTS

| | | | | |
|---|---|---|---|---|
| 6,942,300 | B2 * | 9/2005 | Numa | A47C 7/282 297/218.3 |
| 7,201,449 | B2 * | 4/2007 | Tsai | A47C 1/03 297/411.36 |
| 7,425,037 | B2 | 9/2008 | Schmitz et al. | |
| 7,441,758 | B2 | 10/2008 | Coffield et al. | |
| 7,857,390 | B2 | 12/2010 | Schmitz et al. | |
| 8,025,334 | B2 | 9/2011 | Schmitz et al. | |
| 8,465,007 | B2 | 6/2013 | Coffield et al. | |
| 8,534,648 | B2 | 9/2013 | Coffield et al. | |
| 2002/0106479 | A1 | 8/2002 | Coffield et al. | |
| 2005/0194829 | A1 | 9/2005 | Aerts | |
| 2006/0138849 | A1 | 6/2006 | Wilkerson et al. | |
| 2006/0250018 | A1 | 11/2006 | Tsai | |
| 2008/0157580 | A1 * | 7/2008 | Lin | A47C 7/282 297/391 |
| 2010/0007190 | A1 | 1/2010 | Johnson et al. | |
| 2011/0108075 | A1 | 5/2011 | Weber | |

FOREIGN PATENT DOCUMENTS

| | | | |
|---|---|---|---|
| JP | 2013132403 | A | 7/2013 |
| WO | 2013064239 | A1 | 5/2013 |

OTHER PUBLICATIONS

"Mobilegs—Ultra", webpage, publicly available prior to Jun. 29, 2015, http://www.mobilegs.com/index.cfm?fuseaction=home.products_mobiultra[Jun. 29, 2018 8:08:38 AM], (1 page).

Search Report issued from the European Patent office for related Application No. 16818702.9 dated Mar. 13, 2019 (4 Pages).

* cited by examiner

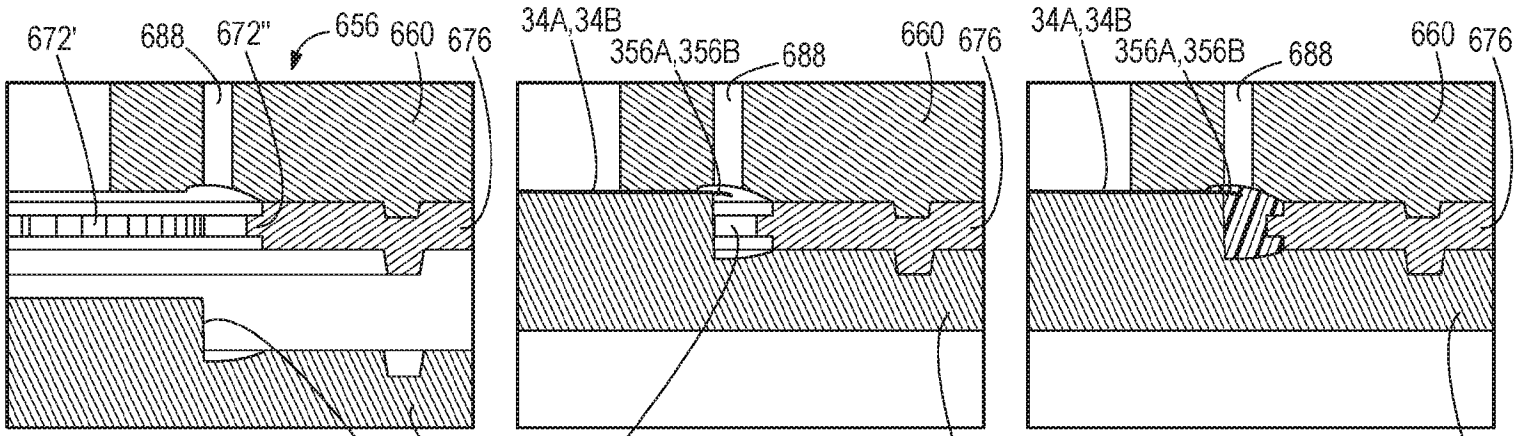
FIG. 19A
FIG. 19B
FIG. 19C
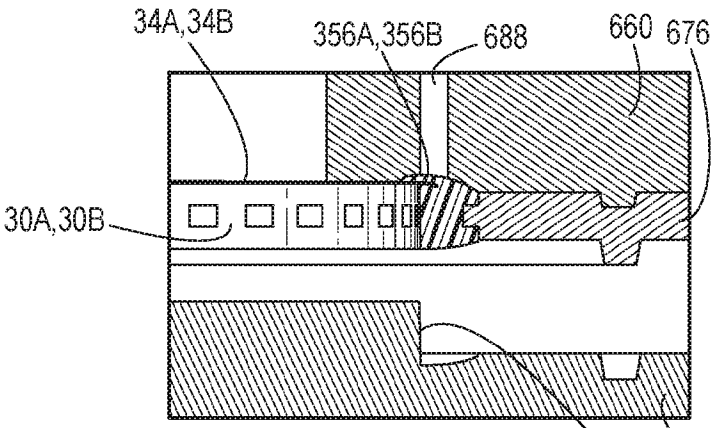
FIG. 19D
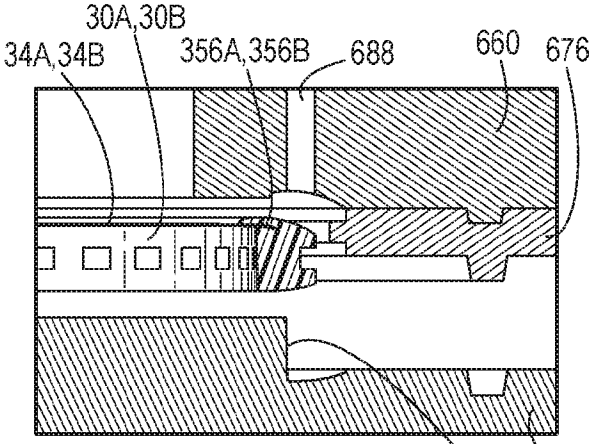
FIG. 19E

ATTACHMENT STRUCTURE FOR SUSPENSION SEATING

CROSS REFERENCE TO RELATED APPLICATIONS

This application claims priority to U.S. Provisional Patent Application No. 62/185,932, filed Jun. 29, 2015, and to U.S. Provisional Patent Application No. 62/266,200, filed Dec. 11, 2015, the entire contents of which are incorporated by reference herein.

BACKGROUND

The present invention relates to a suspension seating structure, such as a chair or a stool, including an attachment structure for a suspension material and a method of manufacturing and using the same.

Suspension seating structures may have a suspension material secured to a frame over an opening. Often, the suspension material is put in tension over the opening. When used as a seat, the suspension material should be able to sustain relatively large tension loads applied by a user. In some seating structures, the suspension material may be trapped or captured by the frame. In other seating structures, the suspension material may be coupled to a carrier member, which is connected to the frame. Often, the frame forms a ring around the opening, or has a substantially non-linear perimeter, making it difficult to properly size and assemble the carrier onto the frame to subject the suspension material to a desired amount of tension over the opening. Similarly, it is difficult for the suspension material to have a desired load carrying capability.

SUMMARY

In one embodiment, the invention provides a seating structure including a frame having first and second side frame members spaced apart in a first direction and defining an opening therebetween. The first and second side frame members each have an inner portion facing toward the opening and an outer portion facing away from the opening. The outer portion includes a plurality of first attachment features facing outwardly away from the first and second side frame members in the first direction. The seating structure also includes a carrier having first and second side carrier members. The first and second side carrier members each include a plurality of second attachment features facing toward the first and second side frame members in the first direction. The plurality of second attachment features engages the plurality of first attachment features to attach the carrier to the frame. The seating structure further includes a suspension material attached to the carrier and extending over the opening in the frame.

In another embodiment, the invention provides a seating structure including a frame having first and second cross frame members spaced apart in a first direction and defining an opening therebetween. The first and second cross frame members each have an inner portion facing toward the opening, an outer portion facing away from the opening, and an upper surface disposed between the inner portion and the outer portion. The seating structure also includes a carrier having first and second cross carrier members spaced apart in the first direction. The first and second cross carrier members are coupled to the frame. The first cross carrier member has an upper lip overlying the upper surface of the first cross frame member and a plurality of ribs extending from the upper lip. The plurality of ribs engages the upper surface of the first cross frame member and supports the upper lip above the upper surface of the first cross frame member. The seating structure further includes a suspension material embedded in the upper lip of the carrier. The upper lip covers a first surface of the suspension material, and the plurality of ribs extends outwardly from a second surface of the suspension material.

In another embodiment, the invention provides a seating structure including a frame comprising of a plurality of frame members including a first frame member and a second frame member. The frame defines an opening between the plurality of frame members. The first frame member has a boss extending from a first end of the first frame member and a tab movably coupled to the boss. The second frame member has a bore formed in an edge of the second frame member and a recess formed in a surface of the second frame member adjacent the bore. The bore receives the boss to align the first frame member with the second frame member. The recess receives the tab to secure the boss within the bore. The seating structure further includes a carrier attached to the first frame member and to the second frame member, and a suspension material attached to the carrier and extending over the opening in the frame.

In another embodiment, the invention provides a method of assembling a seating structure. The method includes providing a frame having first and second side frame members spaced apart in a first direction and defining an opening therebetween. The first and second side frame members each have an inner portion facing toward the opening and an outer portion facing away from the opening. Each outer portion includes a plurality of first attachment features facing outwardly away from the first and second frame members in the first direction. The method also includes providing a carrier having first and second side carrier members. The side carrier members each include a plurality of second attachment features facing toward the first and second side frame members in the first direction. The method further includes attaching a suspension material to the carrier, and engaging the plurality of second attachment features with the plurality of first attachment features to attach the carrier to the frame so the suspension material extends over the opening in the frame.

Other aspects of the invention will become apparent by consideration of the detailed description and accompanying drawings.

BRIEF DESCRIPTION OF THE DRAWINGS

FIGS. 19A-19E show a method of manufacturing a carrier according to some embodiments of the present invention.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1B:
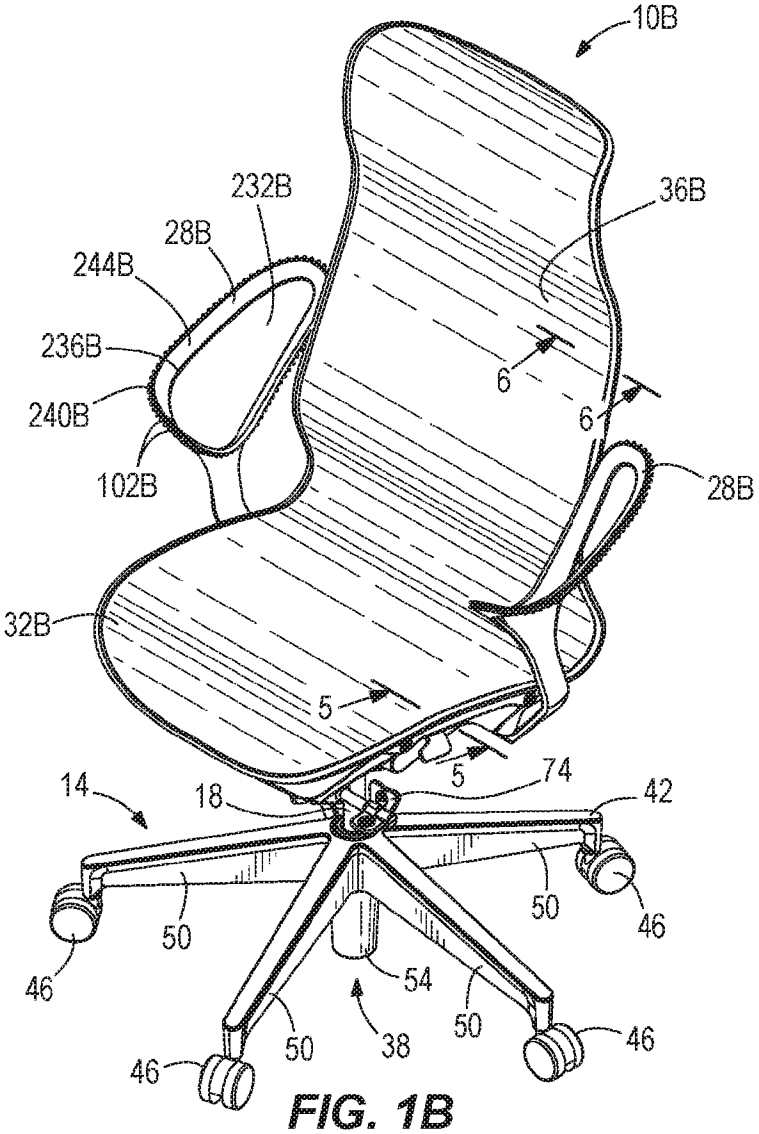
FIG. 1B is a perspective view of another chair according to some embodiments of the present invention.
Figure 1A:
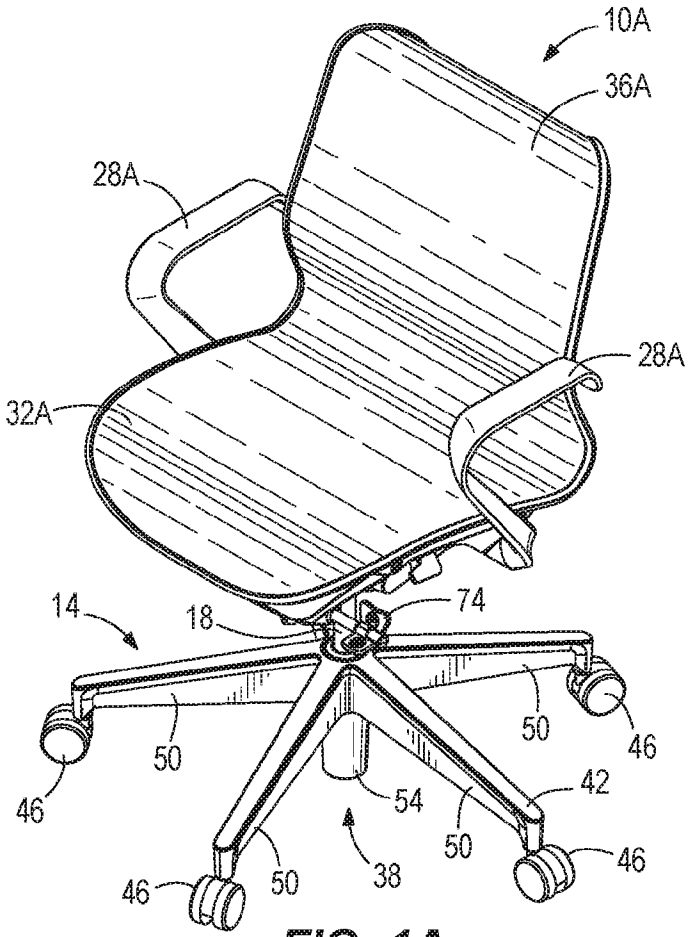
FIG. 1A is a perspective view of a chair according to some embodiments of the present invention.

FIGS. 1A-1B illustrate seating structures 10A, 10B embodying the present invention. The illustrated seating structures 10A, 10B are office chairs, which are also commonly referred to as task chairs. Each seating structure 10A, 10B includes a base 14, a support column 18, a tilt mechanism 22 (FIGS. 2A, 2B), a frame 26A, 26B (FIGS. 2A, 2B), armrests 28A, 28B, a carrier 30A, 30B, and a suspension material 34A, 34B. In the illustrated embodiments, the bases 14, the support columns 18, and the tilt mechanisms 22 are the same, and the frames 26A, 26B, the carriers 30A, 30B, and the suspension materials 34A, 34B are substantially similar. In particular, the frame 26A, the carrier 30A, and the suspension material 34A of the seating structure 10A shown in FIG. 1A are configured to form a chair with a relatively low backrest 36A, while the frame 26B, the carrier 30B, and the suspension material 34B of the seating structure 10B shown in FIG. 1B are configured to form a chair with a relatively high backrest 36B. Other differences between the seating structures 10A, 10B will also be discussed below.

As shown in FIGS. 1A-1B, each base 14 includes a rigid understructure 38, an outer cover 42, and a plurality of casters 46. The rigid understructure 38 supports the weight of the seating structure 10A, 10B. The rigid understructure 38 includes five arms 50 surrounding a central hub 54. One of the casters 46 is attached to a distal end of each of the arms 50. The rigid understructure 38 is made of metal (e.g., aluminum, steel, etc.), a heavy plastic, or a composite material. The outer cover 42 is positioned over the rigid understructure 38. In some embodiments, the rigid understructure 38 and the outer cover 42 may be integrally formed from metal or a rigid plastic. In some embodiments, the outer cover 42 may be overmolded onto the rigid understructure 38.

As shown in FIGS. 1A-1B and 2A-2B, the support column 18 of each seating structure 10A, 10B extends vertically from the base 14. The support column 18 includes a lower end 62, an upper end 66, telescoping segments 70, and an actuator 74. The lower end 62 of the support column 18 is rotatably attached to the base 14. The upper end 66 of the support column 18 is attached to the tilt mechanism 22. The support column 18 includes the telescoping segments 70 that are adjustable to change a height of a seat 32A, 32B. The actuator 74 may be attached to the support column 18 with a cable guide and a cable.

Figure 2A:
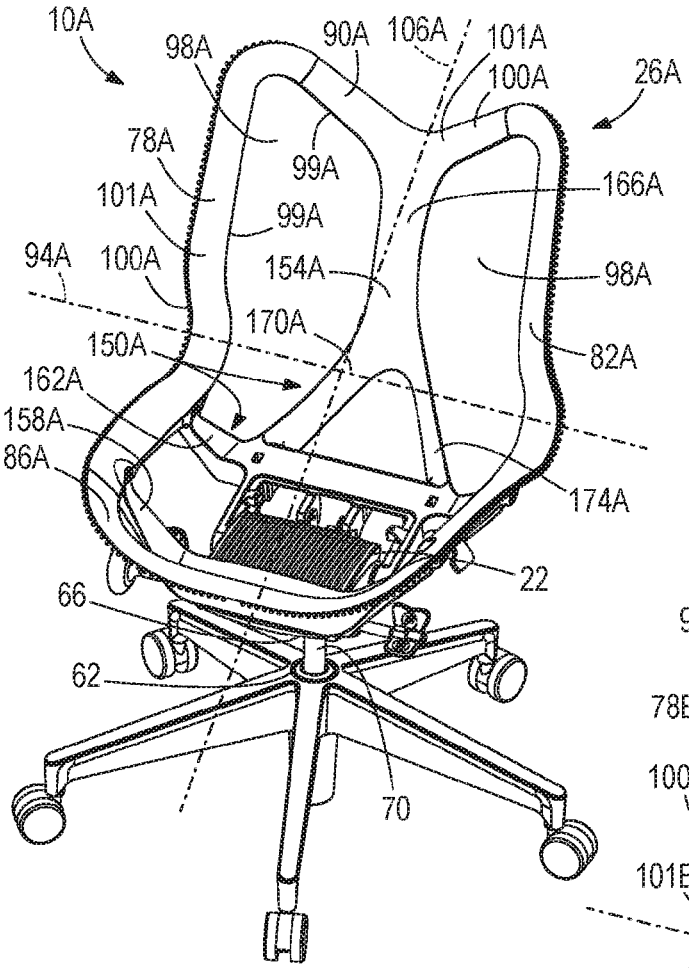
FIG. 2A is a perspective view of the chair of FIG. 1A with a carrier and a suspension material removed.
Figure 2B:
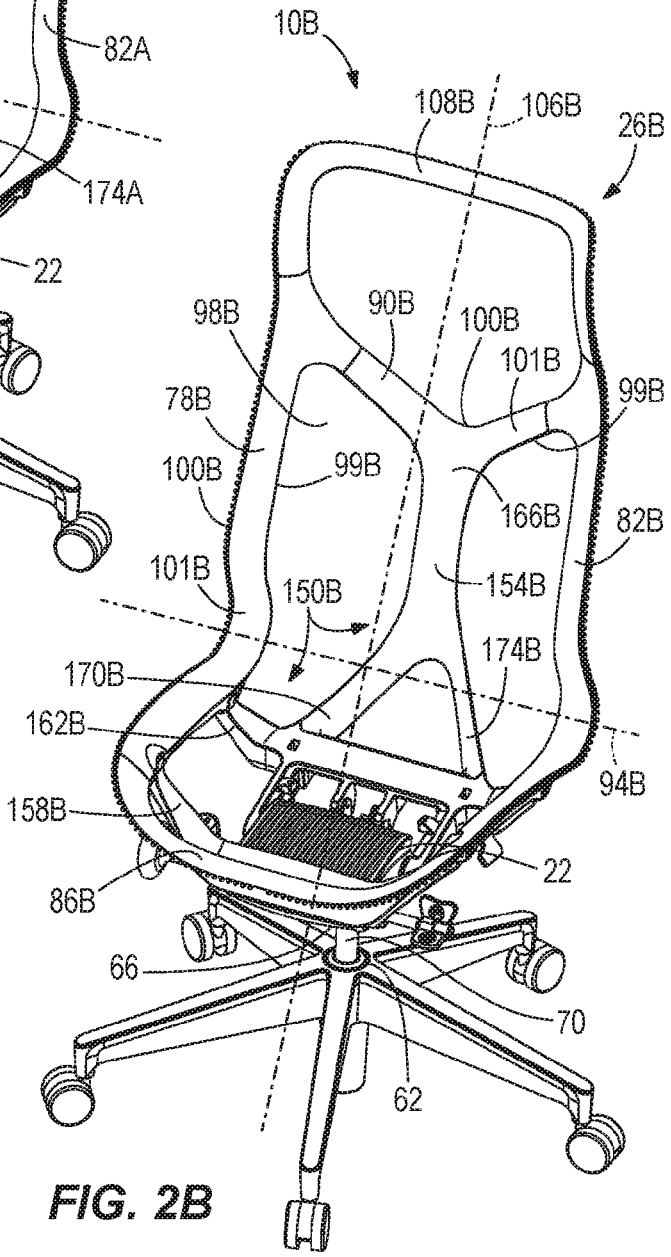
FIG. 2B is a perspective view of the chair of FIG. 1B with a carrier and a suspension material removed.

As shown in FIGS. 2A-2B, the tilt mechanism 22 of each seating structure 10A, 10B is coupled to the upper end 66 of the support column 18 opposite the base 14 and is coupled to a portion of the frame 26A, 26B. The tilt mechanism 22 is configured to allow the frame 26A, 26B to pivot (e.g., tilt) relative to the support column 18.

As shown in FIGS. 2A-2B, the frame 26A, 26B of each seating structure 10A, 10B is supported by the tilt mechanism 22 above the base 14. Each frame 26A, 26B includes a plurality of frame members. More particularly, each frame 26A, 26B includes a first side frame member 78A, 78B, a second side frame member 82A, 82B, a first cross frame member 86A, 86B, and a second cross frame member 90A, 90B. The first side frame member 78A, 78B and the second side frame member 82A, 82B are spaced apart along a first axis 94A, 94B, and define an opening 98A, 98B therebetween. The first cross frame member 86A, 86B and the second cross frame member 90A, 90B are spaced apart along a second axis 106A, 106B that is substantially perpendicular to the first axis 94A, 94B. The first cross frame member 86A, 86B and the second cross frame member 90A, 90B span the opening 98A, 98B and are connected to the first side frame member 78A, 78B and the second side frame member 82A, 82B. The first side frame member 78A, 78B, the second side frame member 82A, 82B, the first cross frame member 86A, 86B, and the second cross frame member 90A, 90B each have an inner portion 99A, 99B facing toward the opening 98A, 98B and an outer portion 100A, 100B facing away from the opening 98A, 98B. A support surface 101A, 101B extends between the inner portion 99A, 99B and the outer portion 100A, 100B. A plurality of first attachment features 102A, 102B is disposed along the outer portion 100A, 100B so that the plurality of first attachment features 102A, 102B surrounds an outer perimeter of the frame 26A, 26B. The plurality of first attachment features 102A. 102B faces outwardly away from the first side frame member 78A, 78B, the second side frame member 82A, 82B, the first cross frame member 86A, 86B, and the second cross frame member 90A, 90B. As shown in FIGS. 5, 6, and 7A-7D, the first attachment features 102A, 102B are teeth 104A, 104B.

In the illustrated embodiment, the first side frame member 78A, 78B, the second side frame member 82A, 82B, the first cross frame member 86A, 86B, and the second cross frame member 90A, 90B form a closed loop or ring. In some embodiments, ends of some or all of the frame members 78A, 78B, 82A, 82B, 86A, 86B, 90A, 90B are curved to provide relatively smooth transitions between the frame members and to provide rounded corners for the frames 26A, 26B. Although the illustrated frames 26A, 26B are formed of separate frame members, in other embodiments, the frames 26A, 26B may be formed as single homogenous units. In some embodiments, the frames 26A, 26B are made of glass filled and unfilled thermoplastics.

In the illustrated embodiment, each frame 26A, 26B is contoured to define both the seat 32A, 32B and the backrest 36A, 36B. In other words, each frame 26A, 26B defines a continuous seat and backrest. The first cross frame members 86A, 86B and lower portions of the side frame members 78A, 78B, 82A, 82B are generally planar to define the seats 32A, 32B, while the second cross frame members 90A, 90B and upper portions of the side frame members 78A, 78B, 82A, 82B are generally planar to define the backrests 36A, 36B. In other embodiments, each frame 26A, 26B may be substantially planar and define only the seat 32A, 32B. In further embodiments, each frame 26A, 26B may be substantially planar and define only the backrest 36A, 36B.

Figure 4:
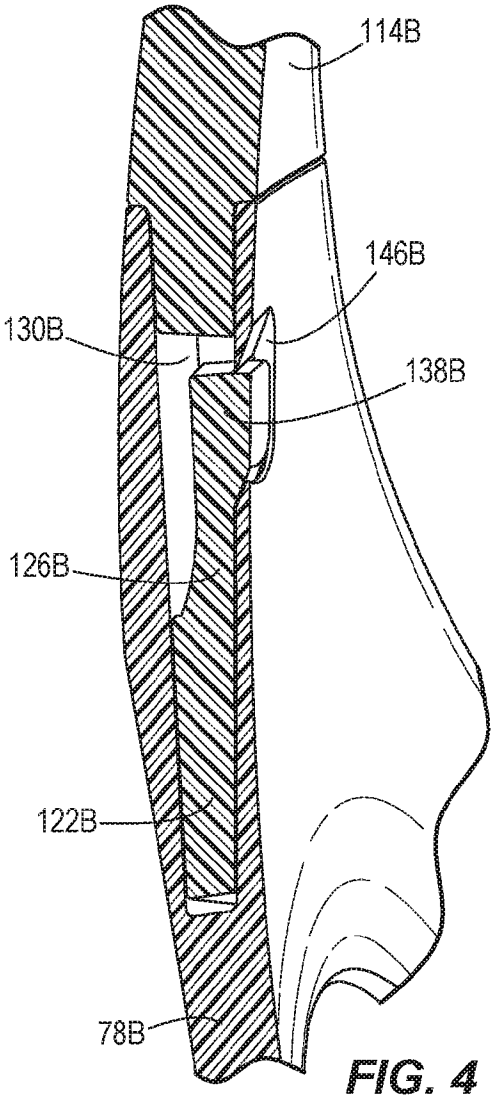
FIG. 4 is a cross-sectional view of the portion of the frame taken along section line 4-4 of FIG. 3.
Figure 3:
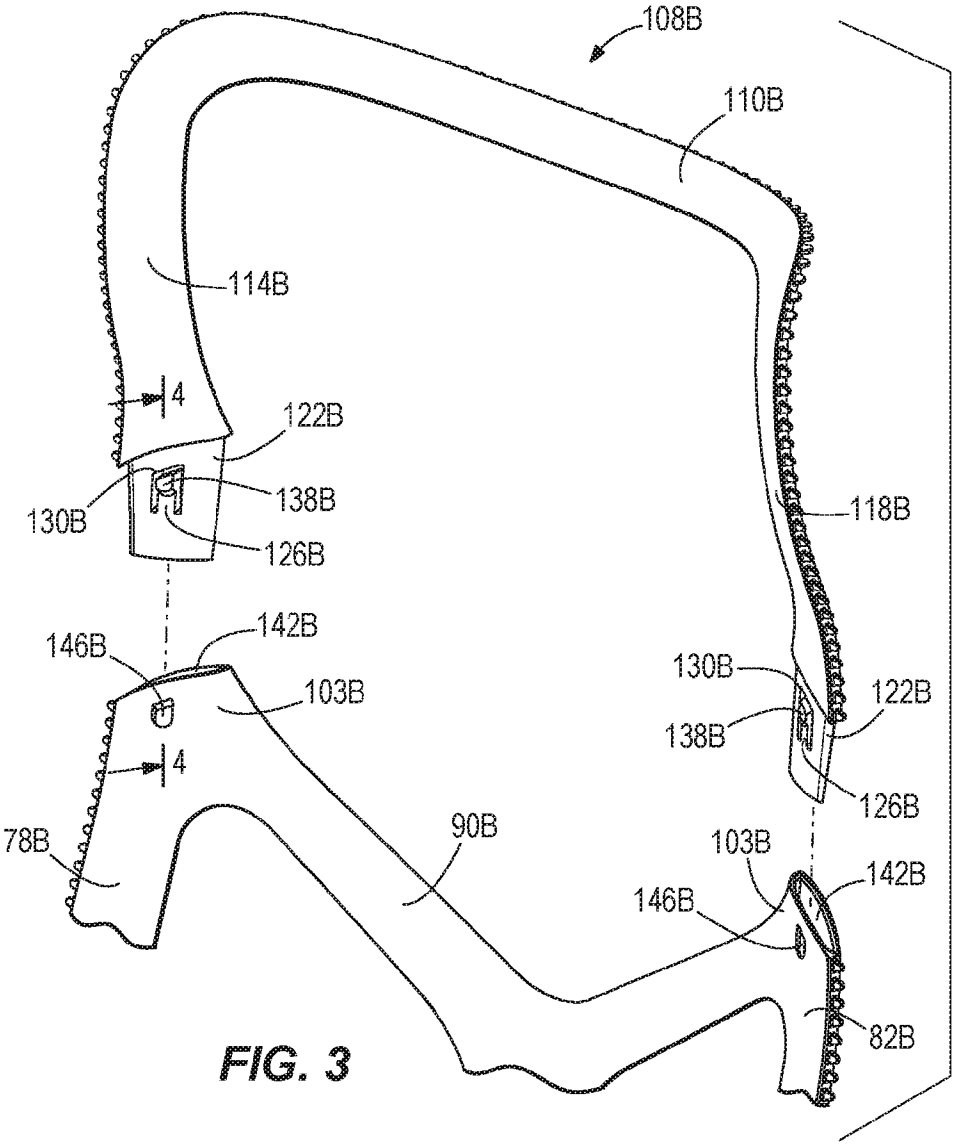
FIG. 3 is an exploded perspective view of a portion of the frame of the chair shown in FIG. 2B.

As shown in FIGS. 2B, 3, and 4, the frame 26B include a third cross frame member 108B. The third cross frame member 108B includes an elongated body 110B, a first arm 114B, and a second arm 118B. The first arm 114B and the second arm 118B are substantially perpendicular to the elongated body 110B. In some embodiments, curved corners extend between the elongated body 110B and the first arm 114B and the second arm 118B. The first arm 114B and the second arm 118B of the third cross frame member 108B are configured to engage the first side frame member 78B and the second side frame member 82B, respectively. When the third cross frame member 108B is engaged with the first side frame member 78B and the second side frame member 82B, the elongated body 110B of the third cross frame member 108B is vertically spaced from and substantially above the second cross frame member 90B to form the higher backrest 36B.

In the illustrated embodiment, the third cross frame member 108B is secured to the first side frame member 78B and the second side frame member 82B by a snap-fit-type connection. As shown in FIGS. 3 and 4, the first arm 114B and the second arm 118B are substantially similar, and the first side frame member 78B and the second side frame member 82B are substantially similar. As such, only the first arm 114B and the first side frame member 78B will be described in detail below. Like reference numbers are used to refer to like parts on the second arm 118B and the second side frame member 82B.

As shown in FIG. 3, the first arm 114B includes a boss 122B extending from an end of the first arm 114B and a tab 126B movably coupled to the boss 122B. The boss 122B has a cross-section that is smaller than a cross-section of the remainder of the first arm 114B. The tab 126B is surrounded by a slot 130B so that the tab 126B is cantilevered on the boss 122B and may move (e.g., flex) with respect to the boss 122B. The tab 126B also includes an enlarged distal end portion 138B.

Referring to FIGS. 3 and 4, the first side frame member 78B has a bore 142B formed in an edge of the first side frame member 78B and a recess 146B formed in a surface of the first side frame member 78B adjacent the bore 142B. The bore 142B is shaped to receive the boss 122B. The recess 146B is formed in an interior surface of the first side frame member 78B that partially defines the bore 142B. In the illustrated embodiment, the recess 146B is a through-hole that also extends through an exterior surface of the first side frame member 78B. In other embodiments, the recess 146B may be a depression formed in the interior surface of the side frame member 78B. The recess 146B is configured to receive the enlarged distal end portion 138B of the tab 126B. In particular, the boss 122B is slid into the bore 142B until the enlarged distal end portion 138B of the tab 126B aligns with the recess 146B, at which point the tab 126B snaps outward (due to the bias of the material) and into the recess 146B, securing the frame members 78B, 108B together. The boss 122B with the tab 126B and the bore 142B with the recess 146B thereby connect the third cross frame member 108B to the first and second side frame members 78B, 82B together without additional fasteners or tools. In alternate configurations, the first side frame member 78B may include the boss 122B and the tab 126B, and the first arm 114B may include the bore 142B and the recess 146B.

As shown in FIGS. 2A and 2B, the frame 26A, 26B of each seating structure 10A, 10B includes a support assembly 150A, 150B to support the frame 26A, 26B. The support assembly 150A. 150B includes a central spine 154A, 154B, a first lower support member 158A, 158B, and a second lower support member 162A, 162B. The central spine 154A, 154B is substantially Y-shaped and includes a first arm 166A, 166B, a second arm 170A, 170B, and a third arm 174A, 174B. The first arm 166A, 166B is coupled to the second cross frame member 90A, 90B. In some embodiments, the first arm 166A, 166B is integrally formed with the second cross frame member 90A, 90B. The second arm 170A, 170B and the third arm 174A, 174B of the central spine 154A, 154B extend beneath the seat 32A, 32B and are coupled to the tilt mechanism 22 through the second lower support member 162A, 162B. The first lower support member 134A, 134B and the second lower support member 162A, 162B extend laterally beneath the first side frame member 78A, 78B and the second side frame member 82A, 82B. The first lower support member 158A, 158B and the second lower support member 162A, 162B include upwardly curving ends configured engage to the first side frame member 78A, 78B and the second side frame member 82A, 82B.

With reference to FIGS. 7A-7D, the teeth 104A, 104B are evenly spaced along the outer portion 100A, 100B of the frame 26A, 26B. Each tooth 104A, 104B has a proximal end 200A, 200B and a curved distal end 204A, 204B, with a length 208A, 208B defined therebetween. The teeth 104A, 104B may have the same length. The length 208A, 208B of the teeth 104A, 104B is less than a thickness 212A, 212B of the frame 26A, 26B. The teeth 104A, 104B are tapered so that the proximal end 200A, 200B of the each tooth 104A, 104B has a first width 216A, 216B and the curved distal end 204A, 204B of each tooth 104A, 104B has a second width 220A, 220B that is shorter than the first width 216A, 216B. The teeth 104A, 104B have a substantially constant height 224A, 224B. There is an even spacing 228A, 228B between adjacent teeth 104A, 104B. The spacing 228A, 228B between adjacent teeth 104A, 104B is substantially equal to the first width 216A, 216B of the teeth 104A, 104B. The first width 216A, 216B of the teeth 104A, 104B may range between about 4 mm to about 25 mm. The length 208A. 208B of the teeth 104A, 104B may range between about 4 mm to about 8 mm. The height 224A, 224B of the teeth 104A, 104B may range between about 3 mm to about 5 mm. The spacing 228A, 228B between the teeth 104A, 104B may range between about 4 mm to about 25 mm. The thickness 212A, 212B of the frame 26A, 26B may range between about 6 mm to about 12 mm. The teeth 104A, 104B may have a slight taper along the length 208A, 208B, both in the height 224A, 224B and width dimensions.

As shown in FIG. 1B, the armrests 28B may be loop-shaped and include an opening 232B. The armrests 28B may include an inner portion 236B facing toward the opening 232B and an outer portion 240B facing away from the opening 232B. A support surface 244B may extend between the inner portion 236B and the outer portion 240B. In some embodiments, the plurality of first attachment features 102A, 102B (e.g., teeth) is also disposed along the outer portion 240B of the armrests 28B. In other words, the construction of the armrests 28B may be similar to the frame 26B, but with a different shape and size. The armrests 28B can engage a suitable carrier with a suspension material, similar to the carriers 30A, 30B and the suspension materials 34A, 34 described below.

Figure 8B:
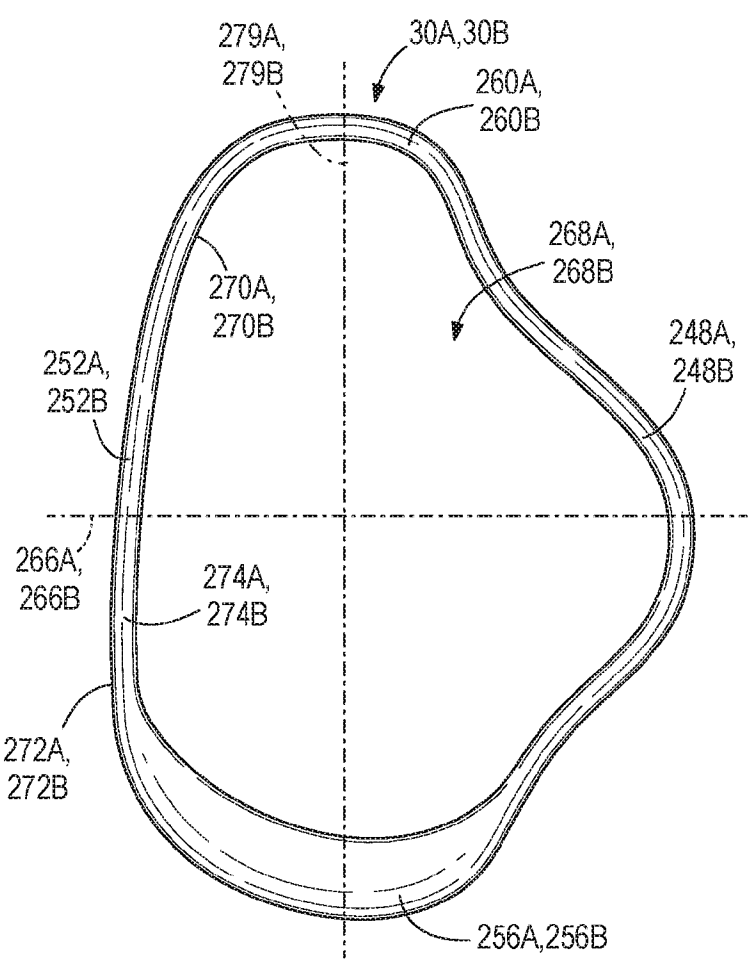
FIGS. 8A-8B show a carrier according to some embodiments of the present invention.
Figure 8A:
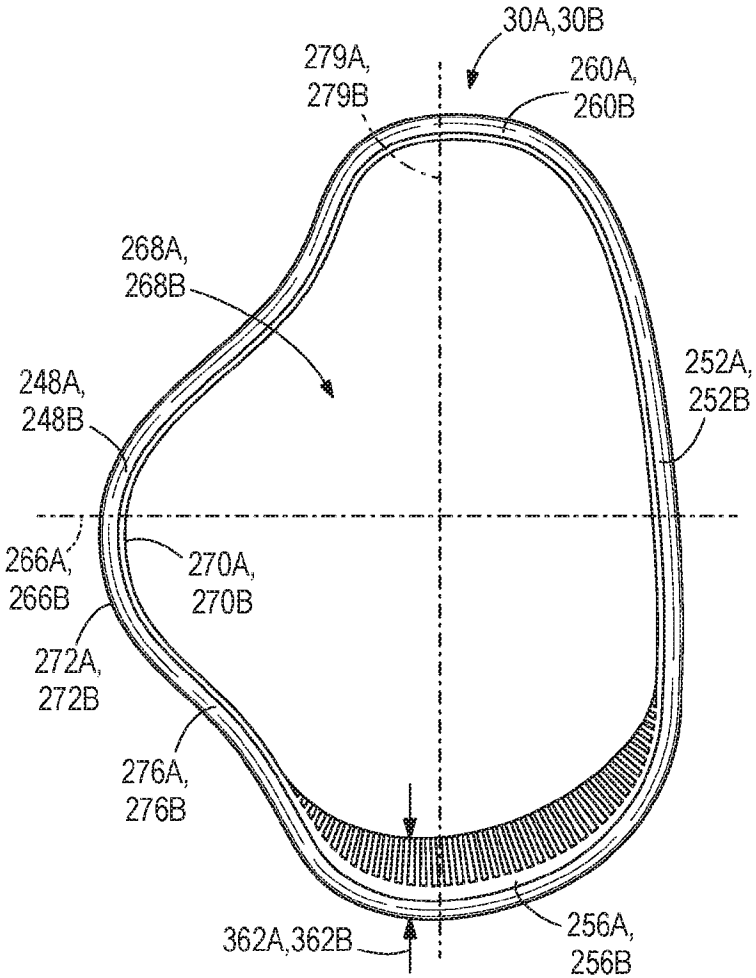

As shown in FIGS. 8A and 8B, each carrier 30A, 30B includes a first side carrier member 248A, 248B, a second side carrier member 252A, 252B, a first cross carrier member 256A. 256B, and a second cross carrier member 260A, 260B. The first side carrier member 248A. 248B and the second side carrier member 252A, 252B are spaced apart along a first axis 266A, 266B and define an opening 268A, 268B therebetween. The first cross carrier member 256A. 256B and the second cross carrier member 260A, 260B are spaced apart along a second axis 279A, 279B that is substantially perpendicular to the first axis 266A, 266B. The first cross carrier member 256A, 256B and the second cross carrier member 260A, 260B span the opening 268A, 268B and are connected to the first side carrier member 248A, 248B and the second side carrier member 252A, 252B. The first side carrier member 248A, 248B, the second side carrier member 252A, 252B, the first cross carrier member 256A, 256B, and the second cross carrier member 260A, 260B each include an inner portion 270A, 270B facing inwardly toward the opening 268A, 268B and an outer portion 272A, 272B facing away from the opening 268A, 268B. An upper support surface 274A, 274B and a lower support surface 276A, 276B extend between the inner portion 270A, 270B and the outer portion 272A, 272B.

Figure 6:
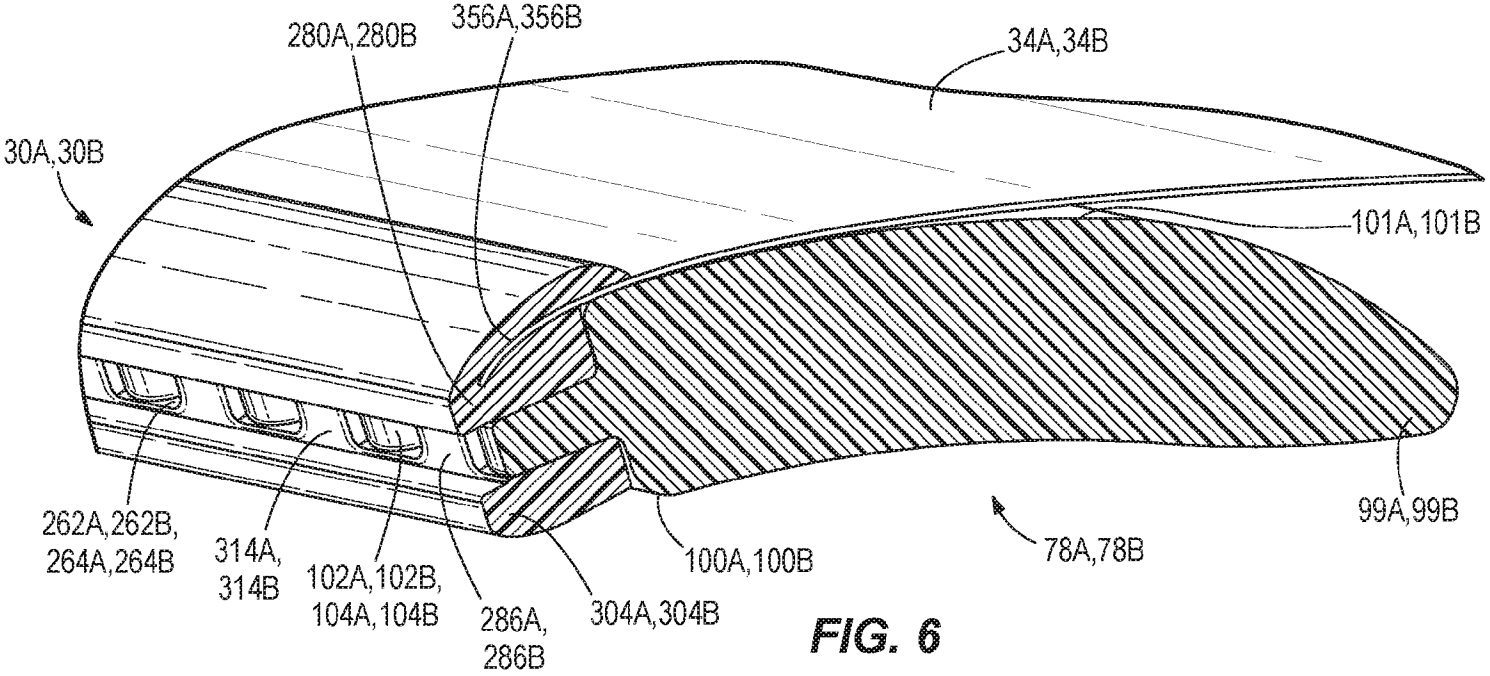
FIG. 6 is a cross-sectional view of a portion of the frame, the carrier, and the suspension material of the chair taken along the section line 6-6 of FIG. 1B.
Figure 7A:
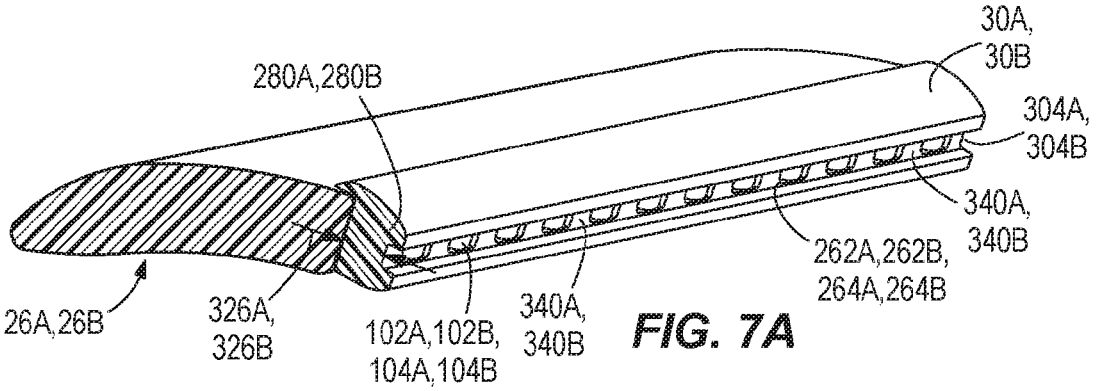
FIGS. 7A-7D show a carrier and a frame according to some embodiments of the present invention.
Figure 7B:
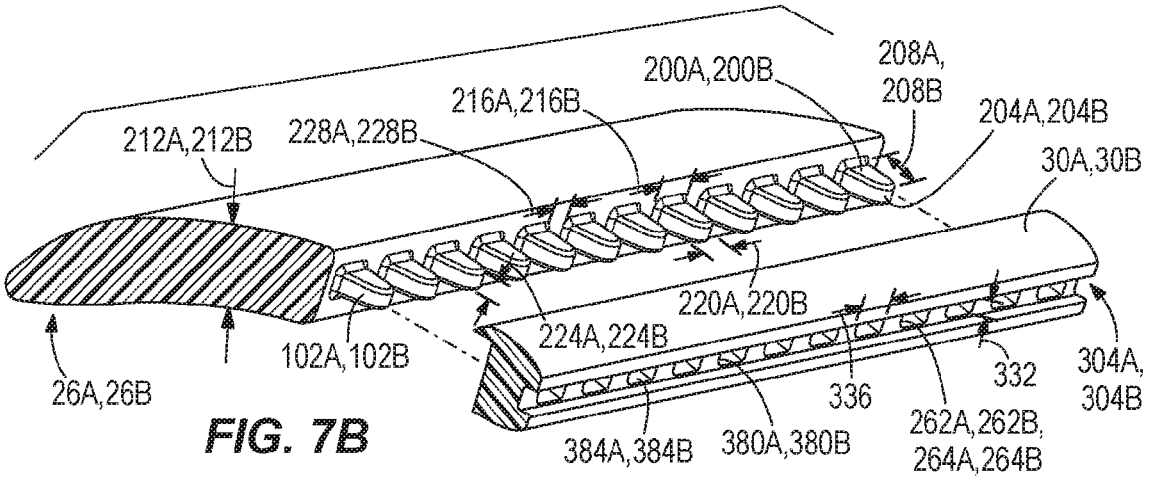
Figure 7C:
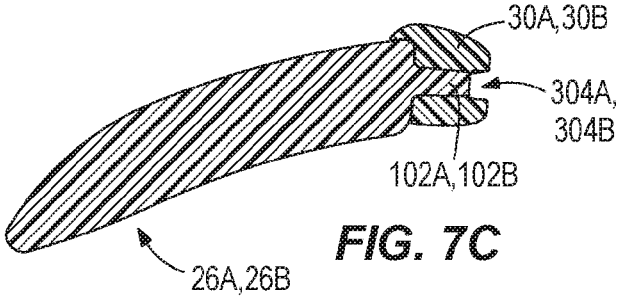
Figure 7D:
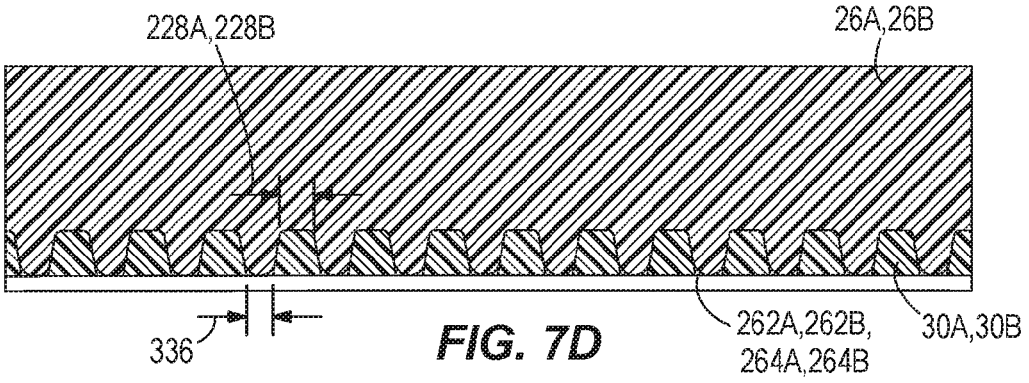

As shown in FIGS. 7A and 7B, each carrier 30A, 30B also includes a plurality of second attachment features 262A, 262B disposed along the inner portion 270A, 270B. The plurality of second attachment features 262A, 262B face toward the first side frame member 78A, 78B, the second side frame member 82A, 82B, the first cross frame member 86A, 86B, and the second cross frame member 90A, 90B. The plurality of second attachment features 262A, 262B is disposed along the inner portion 270A, 270B of the carrier 30A, 30B so that the plurality of second attachment features 262A, 262B surrounds an inner perimeter of the carrier 30A, 30B. As shown in FIGS. 6-7D, the second attachment features 262A, 262B are apertures 264A, 264B. In the illustrated embodiment, the apertures 264A, 264B are through openings. In other embodiments, the second attachment features 262A, 262B may be cavities. The carrier 30A, 30B is attached to the frame 26A, 26B by engaging the plurality of first attachment features 102A, 102B with the plurality of second attachment features 262A, 262B. In some embodiments, the first attachment features 102A, 102B on the frame 26A, 26B may be apertures, and the second attachment features 262A, 262B on the carrier 30A, 30B may be teeth.

In the illustrated embodiment, the first side carrier member 248A, 248B, the second side carrier member 252A, 252B, the first cross carrier member 256A, 256B, and the second cross carrier member 260A, 260B form a closed loop or ring. The illustrated carrier members 248A. 248B, 252A, 252B. 256A, 256B, 260A, 260B are integrally formed as a single homogenous unit. The carriers 30A, 30B may be formed of thermoplastic elastomers, thermoplastic urethanes, and/or unfilled elastomers. In other embodiments, the carriers 30A, 30B may be formed of discrete frame members.

Figure 5:
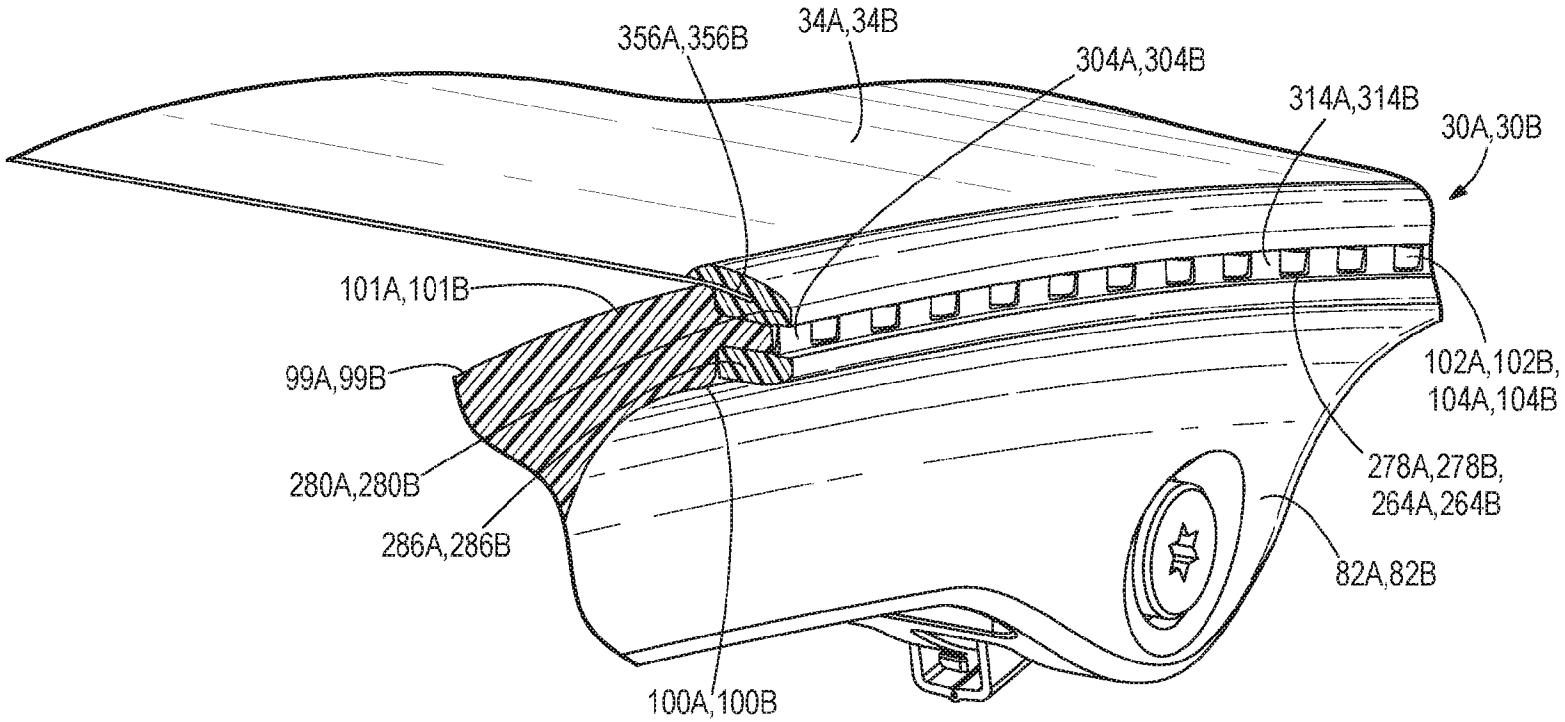
FIG. 5 is a cross-sectional view of a portion of the frame, the carrier, and the suspension material of the chair taken along the section line 5-5 of FIG. 1B.

As shown in FIGS. 8A and 8B, each carrier 30A, 30B includes the upper support surface 274A, 274B and the lower support surface 276A, 276B extending between the inner portion 270A, 270B and the outer portion 272A, 272B. The upper support surface 284A, 284B curves downwardly from an inboard portion to an outboard portion thereof, as shown in FIGS. 5-6. The upper support surface 284A, 284B includes an upper lip 280A, 280B having a portion that extends inwardly and overlies the suspension material 34A, 34B and a top of the frame 26A, 26B. The lower support surface 288A, 288B may engage the support surface 101A, 101B of the frame 26A, 26B. The first cross carrier member 256A, 256B and the second cross carrier member 260A, 260B include an outwardly extending lower lip 286A, 286B. The carrier 30A, 30B also includes a channel 304A, 304B that opens outwardly and away from the opening 268A, 268B of the carrier 30A, 30B. As shown in FIGS. 5-6 and 7A-7D, in some embodiments, the first side carrier member 248A, 248B, the second side carrier member 252A, 252B, the first cross carrier member 256A, 256B, and the second cross carrier member 260A, 260B may each include the upper lip 280A, 280B and the lower lip 286A, 286B. The upper lip 280A, 280B and the lower lip 286A, 286B are vertically spaced apart. The upper lip 280A, 280B and the lower lip 286A. 208B are joined together by a plurality of spaced apart posts 314A, 314B. The posts 314A, 314B define the apertures 264A, 264B. Referring to FIG. 7B, in some embodiments, the apertures 264A, 264B are defined by upper and lower landings 380A, 380B, 384A, 384B and the spaced apart posts 314A, 314B. The spaced apart posts 314A, 314B help maintain the shape and integrity of the apertures 264A, 264B in response to the tension in the carrier 30A, 30B when the carrier 30A, 30B is engaged with the frame 26A, 26B and in response to cycles of external loading of the suspension material 34A, 34B (e.g. by the user sitting down).

As shown in FIGS. 7A, 7B, and 7D, the apertures 264A, 264B are evenly spaced along the channel 304A. 304B. A depth of the apertures 264A, 264B is the same as a depth 326A, 326B of the posts 314A, 314B. Each aperture 264A, 264B has a height 332 and a width 336 configured to receive one of the teeth 104A, 104B. As shown in FIG. 7A, the distal ends 204A, 204B of the teeth 104A, 104B lie flush with outer ends 340A, 340B of the posts 314A, 314B when the carrier 30A, 30B is engaged with the frame 26A, 26B so that the distal ends 204A, 204B of the teeth 104A, 104B are disposed within the channel 304A, 304B. The channel 304A, 304B therefore isolates or spaces the distal ends 204A, 204B of the teeth 104A, 104B inwardly from the outer portion 272A, 272B of the carrier 30A, 30B, protecting the teeth 104A, 104B from impact damage. As shown in FIGS. 5, 6, and 7A, the distal ends 204A, 204B of the teeth 104A, 104B of the first attachment features 102A, 102B are visible through the apertures 264A, 264B on sides of the carrier 30A, 30B facing outward from the opening 268A, 268B. In other words, the teeth 104A, 104B are visible along an outer perimeter of the seating structure 10A, 10B to create a "zipperlike" appearance (FIGS. 5-6).

As shown in FIGS. 5-6, the suspension material 34A, 34B is attached to the carrier 30A, 30B and extends over the opening 98A, 98B defined by the frame 26A, 26B. The suspension material 34A, 34B may be made of a woven or knit material, such as elastomeric materials, fabrics, or molded polymeric materials. In some embodiments, the suspension material 34A, 34B forms the seat 32A, 32B, the backrest 36A, 36B, or a continuous seat and backrest of the seating structure 10A, 10B. In some embodiments, the frame 26B, the carrier 30B, and the suspension material 34B also form the armrest 28B.

The suspension material 34A, 34B is coupled to the carrier 30A, 30B. In the illustrated embodiment, the suspension material 34A, 34B is molded into the carrier 30A, 30B. In other embodiments, the suspension material 34A, 34B may be coupled to the carrier 30A, 30B by bonding, adhesives, mechanical fasteners (e.g., staples, screws, etc.), or the like. In embodiments where the suspension material 34A, 34B is molded to the carrier 30A, 30B, an edge 356A, 356B of the suspension material 34A, 34B is captured within the carrier 30A, 30B so that the upper lips 280A, 280B of the carrier 30A, 30B overlie the edge 356A, 356B of the suspension material 34A, 34B.

When the carrier 30A, 30B is attached to the frame 26A, 26B, the suspension material 34A, 34B is stretched over the opening 98A, 98B defined by the frame 26A, 26B so that the suspension material 34A, 34B is in tension. A line of tension 348A, 348B (FIGS. 9A and 9B) is formed between the first side carrier member 248A, 248B and the second side carrier member 252A, 252B.

Figure 9A:
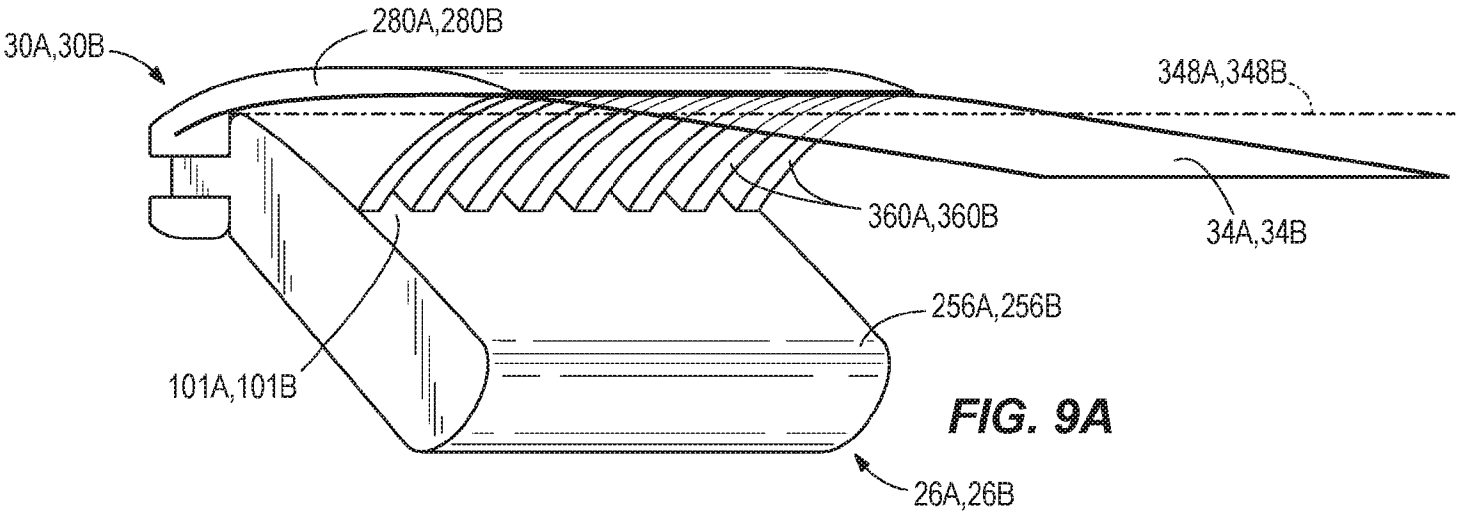
FIGS. 9A-9B are enlarged views of a carrier including ribs according to some embodiments of the present invention.
Figure 9B:
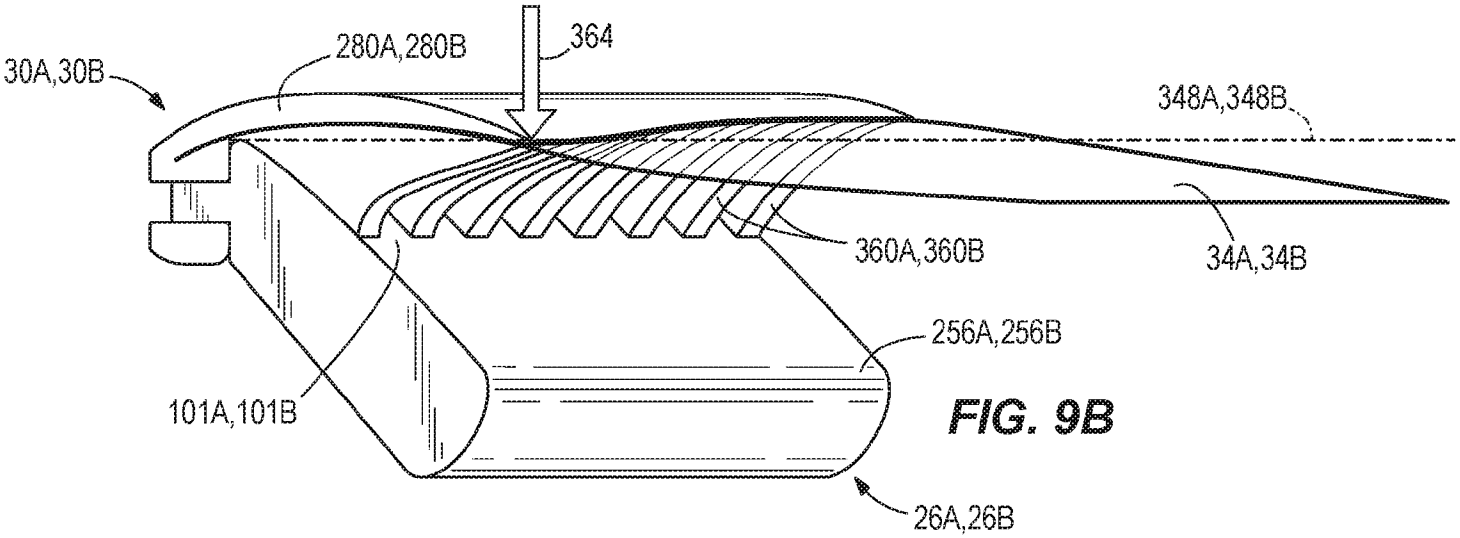

As shown in FIGS. 9A and 9B, the carrier 30A, 30B includes a plurality of ribs 360A, 360B. The ribs 360A, 360B are positioned along the lower surface 288A, 288B of the upper lip 280A, 280B and engage the support surface 101A, 101B of the frame 26A, 26B. The ribs 360A, 360B are generally positioned along portions of the carrier 30A, 30B that may experience point loading, such as along the first cross carrier member 256A, 256B (as shown in FIGS. 9A and 9B) or along the armrests 28B. Each of the plurality of ribs 360A, 360B is generally shaped as a tapered truss. The ribs 360A, 360B are collapsible or deflectable under load. The ribs 360A, 360B are made of a resilient material and function like springs. The ribs 360A, 360B are formed as discrete elements so that only the ribs 360A, 360B that are in close proximity to an applied load 364 deflect (FIG. 9B). The ribs 360A, 360B extend above the line of tension 348A, 348B (FIG. 9B) and support a portion of the suspension material 34A, 34B above the line of tension 348A, 348B to form a positive cushioned curvature above the line of tension 348A, 348B. The ribs 360A, 360B inhibit the suspension material 34A, 34B from contacting the support surface 101A. 101B of the frame 26A, 26B when the suspension material 34A, 34B is subjected to the applied load 364. The ribs 360A, 360B are made of resilient materials, for example rubber or silicone. As shown in FIG. 8A, a width 362A, 362B of the upper lip 280A, 280B and a length of the ribs 360A, 360B may vary along a contour of the frame 26A, 26B.

Figure 10A:
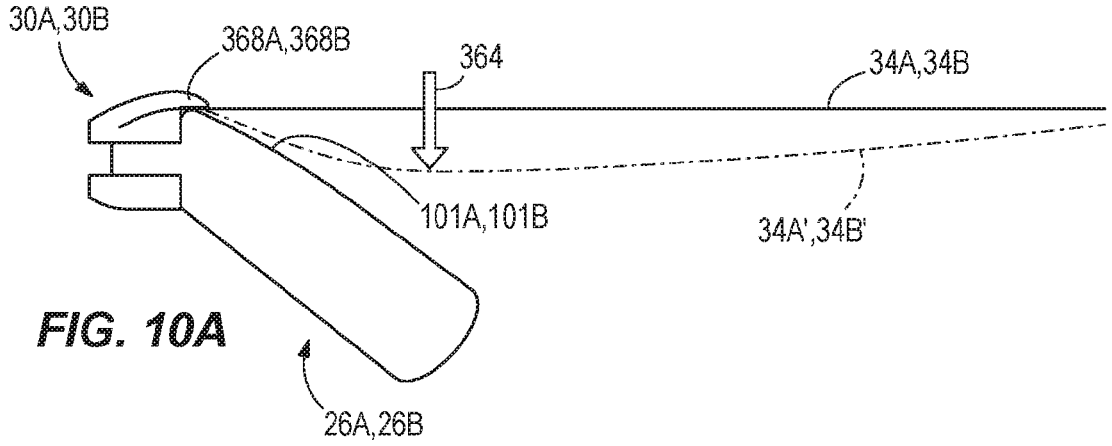
FIGS. 10A-10C show a carrier with and without ribs subjected to a load

As shown in FIG. 10A, in some embodiments, the carrier 30A, 30B may include a shorter upper lip 368A, 368B. In such embodiments, when the suspension material 34A, 34B is subjected to an applied load 364, the suspension material 34A, 34B deflects to the position identified by dashed lines. The deflected suspension material 34A, 34B is proximate the support surface 101A, 101B of the frame 26A, 26B which could expose a user to the hard support surface 101A, 101B of the frame 26A, 26B.

Figure 10B:
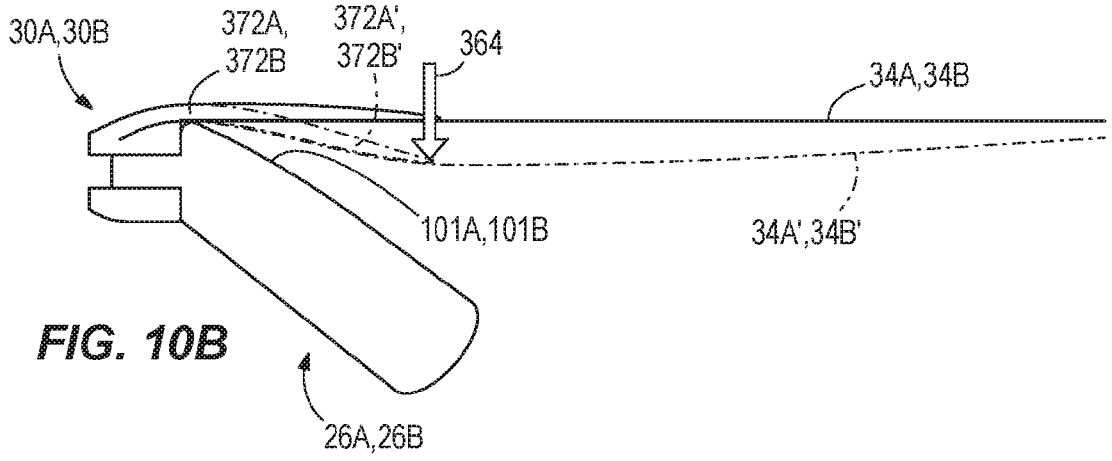

As shown in FIG. 10B, in some embodiments, the carrier 30A, 30B includes an elongated upper lip 372A, 372B. When the suspension material 34A, 34B is subjected to the applied load 364, the suspension material 34A, 34B and the elongated upper lip 372A, 372B deflect to the positions identified by dashed lines. In such an embodiment, the elongated upper lip 372A, 372B provides a resilient cantilevered support and the suspension material 34A, 34B experiences less deflection under the load 364. The user may still be exposed to the hard support surface 101A, 101B of the frame 26A, 26B, although to a lesser extent than in the embodiment shown in FIG. 10A.

Figure 10C:
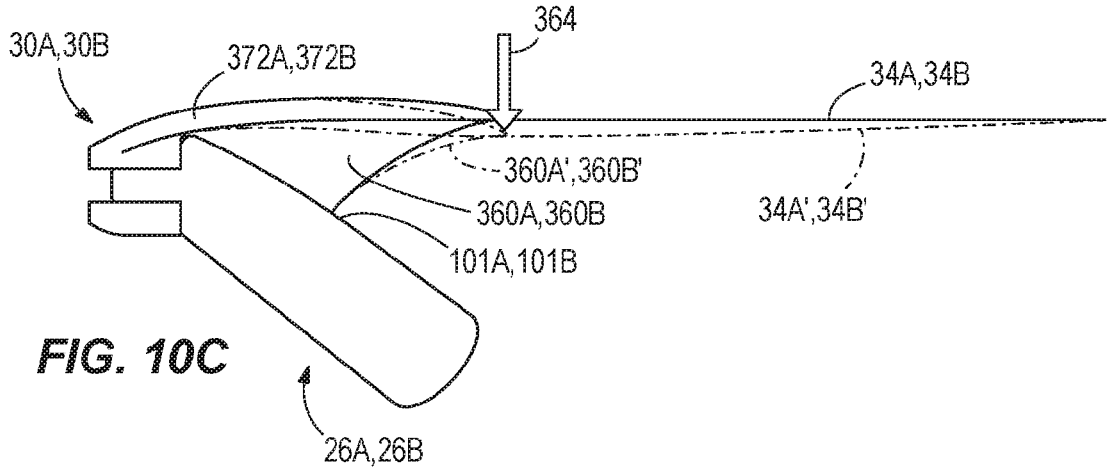

FIG. 10C illustrates an arrangement where the carrier 30A, 30B includes the elongated upper lip 372A, 372B and the plurality of ribs 360A, 360B extending from the elongated upper lip 372A, 372B. When the suspension material 34A, 34B is subjected to the applied load 364, the suspension material 34A, 34B, the elongated upper lip 372A, 372B, and the ribs 360A, 360B deflect to the positions identified by dashed lines. The ribs 360A, 360B hold a portion of the suspension material 34A, 34B over the line of the line of tension 348A, 348B when the load 364 is applied, providing a cushioning effect and inhibiting a user from contacting the support surface 101A, 101B of the frame 26A, 26B. Therefore, the elongated upper lip 372A, 372B and the ribs 360A, 360B may be positioned along portions of the frame 26A, 26B that contact the user (e.g., along the first cross frame member 86A, 86B or along the armrests 28B) to help reduce pressure points at the edges of the seating structure 10A, 10B.

Figure 11B:
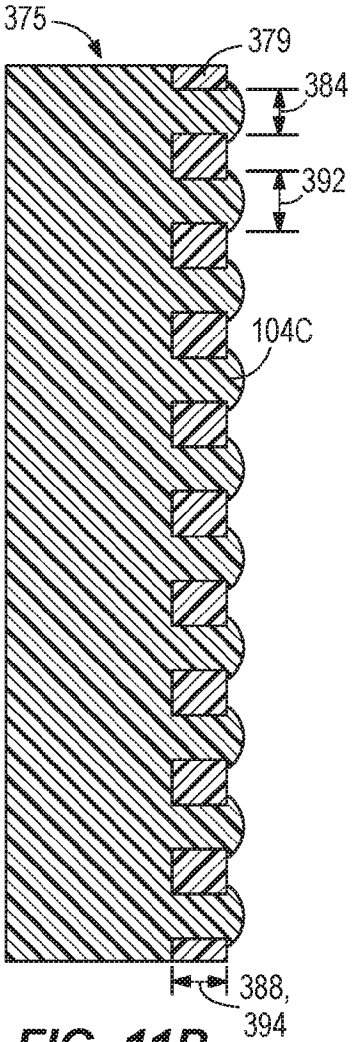
FIGS. 11A-11B show a carrier and a frame according to some embodiments of the present invention.
Figure 11A:
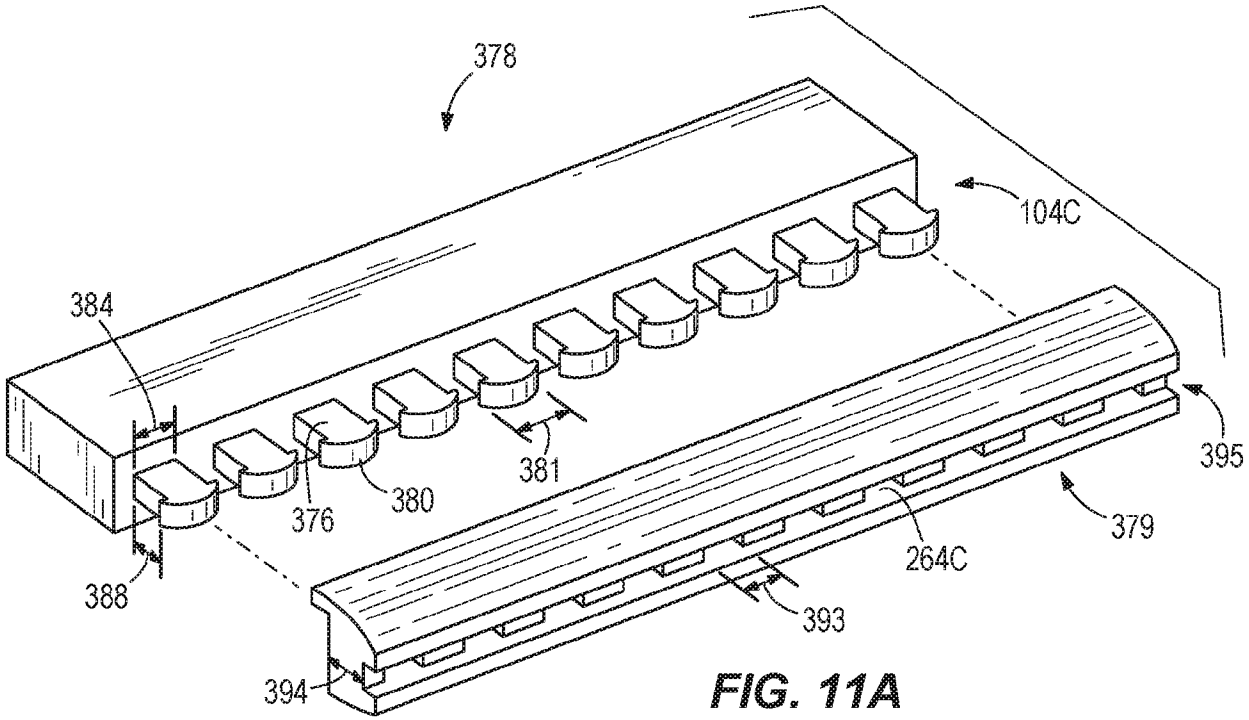

FIGS. 11A-11B illustrate portions of a frame 378 and a carrier 379 with alternative attachment features. In the illustrated embodiment, the first attachment features on the frame 378 include teeth 104C that have a substantially rectangular stem 376 and a barbed distal end 380. A width 384 of the stem 376 is constant along a length 388 of the stem 376, while a width 392 of the barbed distal end 381 is wider than the width 384 of the stem 376. The second attachment features on the carrier 379 include apertures 264C having a width 393 sized to receive the stem 376. A depth 394 of each aperture 264C may be substantially similar to the length 388 of each stem 376. The barbed distal end 380 may extend into a channel 395 of the carrier 379. The width 392 of each barbed distal end 381 is wider than the width 393 of each aperture 264C. The wider widths 392 of the barbed distal ends 380 inhibit the teeth 104C from being pulled out of the carrier 379 in response to loading of the carrier 379.

Figure 12B:
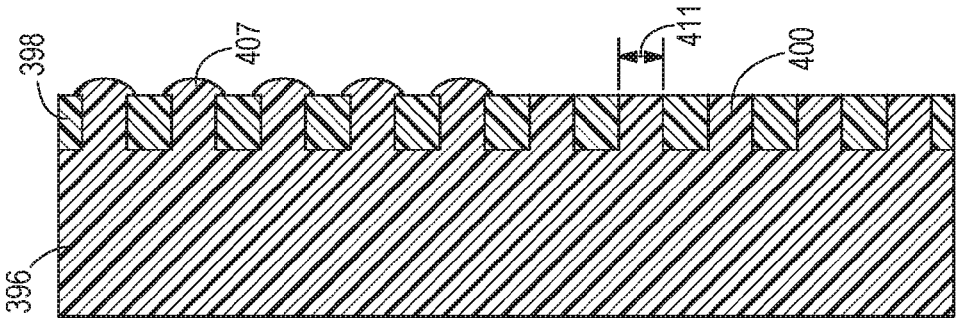
FIGS. 12A-12B show a carrier and a frame according to some embodiments of the present invention.
Figure 12A:
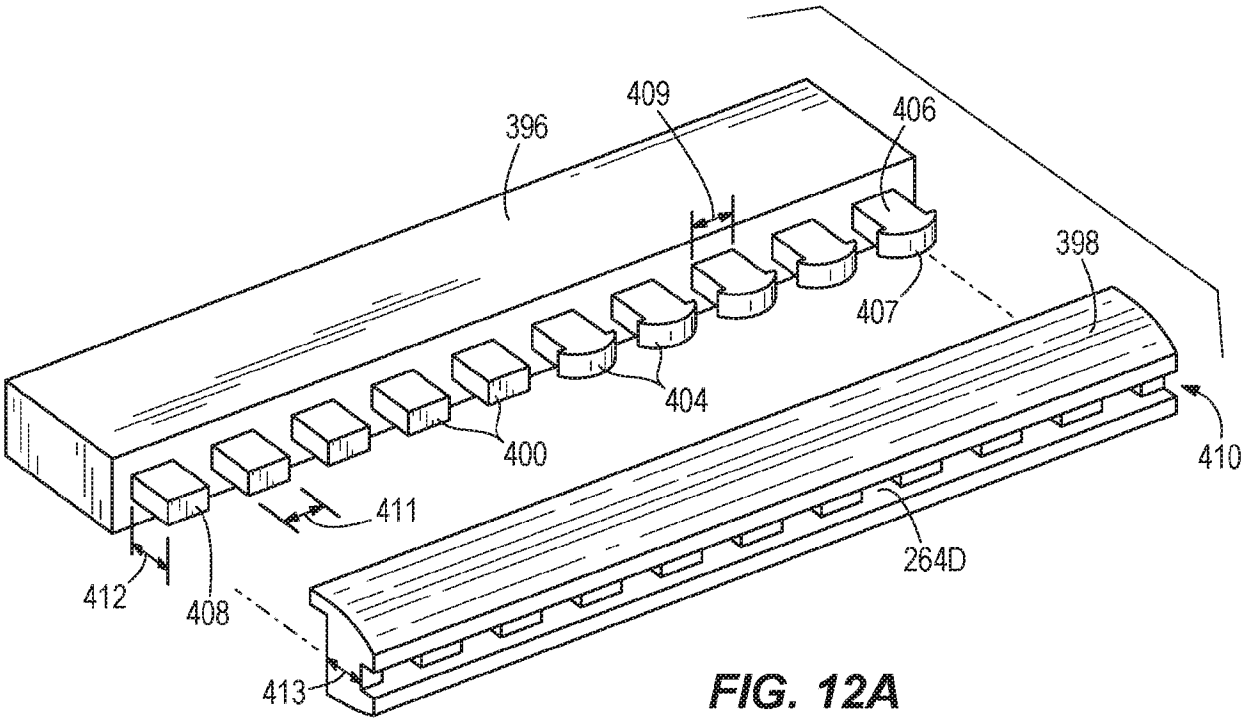

FIGS. 12A-12B illustrate portions of a frame 396 and a carrier 398 with alternative attachment features. In the illustrated embodiment, the first attachment features on the frame 396 include first teeth 400 having a first shape and second teeth 404 having a second shape. The illustrated first teeth 400 are rectangular. The illustrated second teeth 404 have a substantially rectangular stem 406 and a barbed distal end 407, similar to the rectangular stems 376 and the distal ends 380 described above. Each first tooth 404 has a width 411 that is substantially the same as a width 409 of the stem 406. Each first tooth 404 also has a length 412. The second attachment features on the carrier 398 include apertures 264D that are substantially the same as the apertures 264C described above. A depth 413 of each aperture 264D is substantially the same as the length 412 of each first tooth 400. When the carrier 398 is engaged with the frame 396, the barbed distal ends 407 of the second plurality of teeth 408 extend beyond the depth 413 of the apertures 264D and protrude into a channel 410 of the carrier 398. The first teeth 404 do not extend into the channel 410. Since the width of the barbed distal end 407 is wider than the width of the apertures 264D, the barbed distal ends 407 inhibit the teeth 404 from being pulled out of the carrier 398 in response to loading of the carrier 398.

Figure 13B:
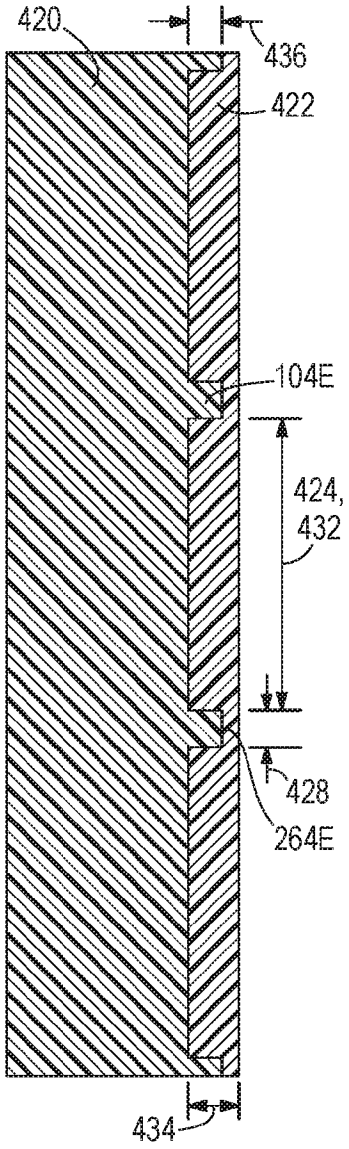
FIG. 13A-13B show a carrier and a frame according to some embodiments of the present invention.
Figure 13A:
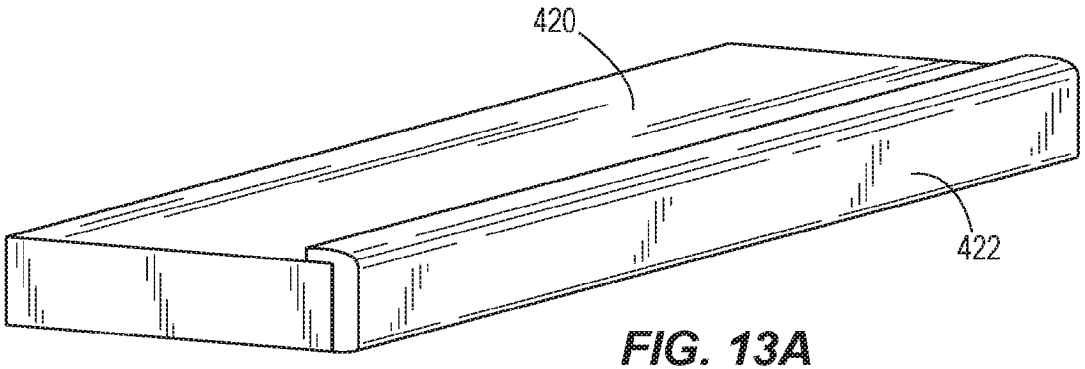

FIGS. 13A-13B illustrate portions of a frame 420 and a carrier 422 with alternative attachment features. In the illustrated embodiment, the first attachment features on the frame 420 include teeth 104E that are spaced relatively far apart. In other words, a spacing 424 between the teeth 104E is greater than a width 428 of each tooth 104E. The second attachment features on the carrier 422 are apertures 264E. A spacing 432 between the apertures 264E corresponds to the spacing 424 between the teeth 104E. In the illustrated embodiment, the apertures 264E are cavities. The apertures 264E have a depth 436 that is less than a width 434 of the carrier 422 so that the teeth 104E are not visible when the frame 420 is engaged with the carrier 422.

Figure 14C:
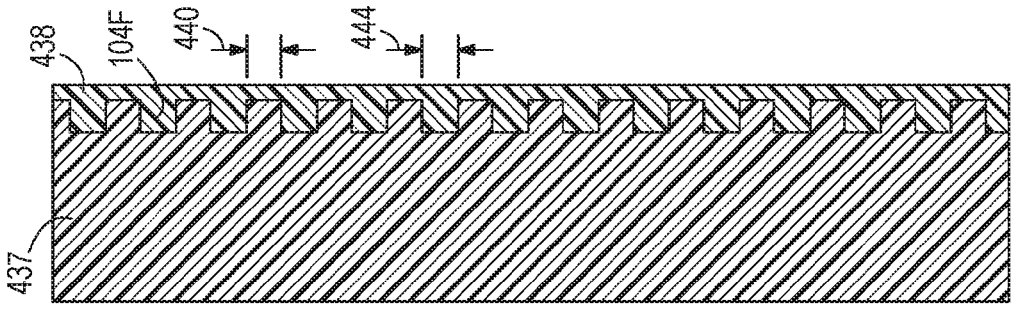
FIG. 14A-14C show a carrier and a frame according to some embodiments of the present invention.
Figure 14A:
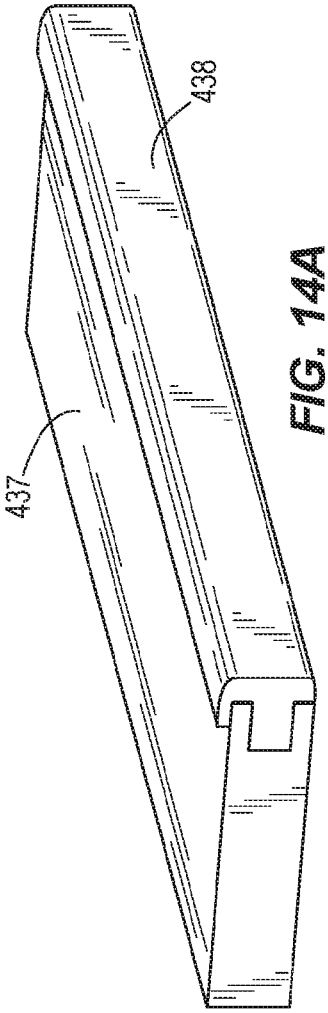
Figure 14B:
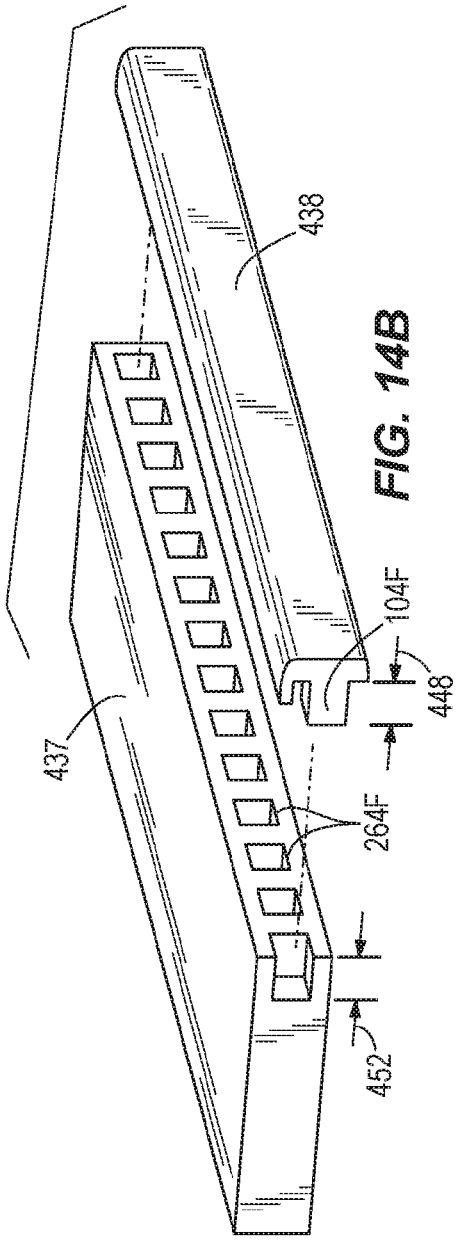

FIGS. 14A-14C illustrate portions of a frame 437 and a carrier 438 with alternative attachment features. In the illustrated embodiment, the frame 437 includes a plurality of first attachment features that are apertures 264F. The carrier 438 includes a plurality of second attachment features that are teeth 104F. The apertures 264F are evenly spaced and have a rectangular cross section. A spacing 440 between the apertures 264F is substantially the same as a width 444 of the apertures 264F. The teeth 104F have a rectangular cross section and have a length 448 that is substantially the same as a depth 452 of the apertures 264F.

Figure 15C:
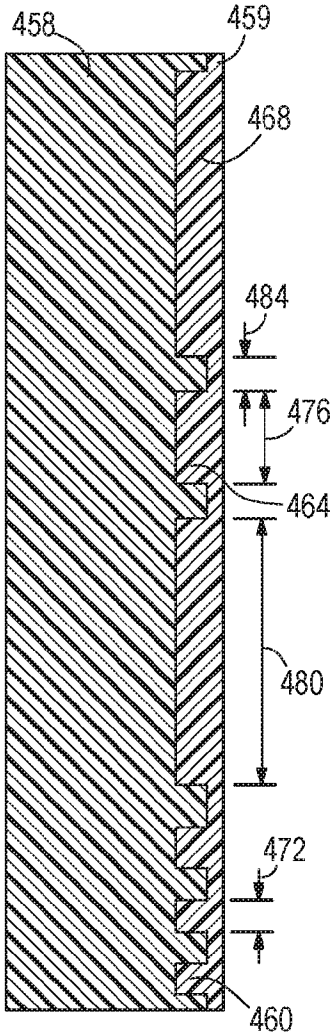
FIGS. 15A-15C show a carrier and a frame according to some embodiments of the present invention.
Figure 15A:
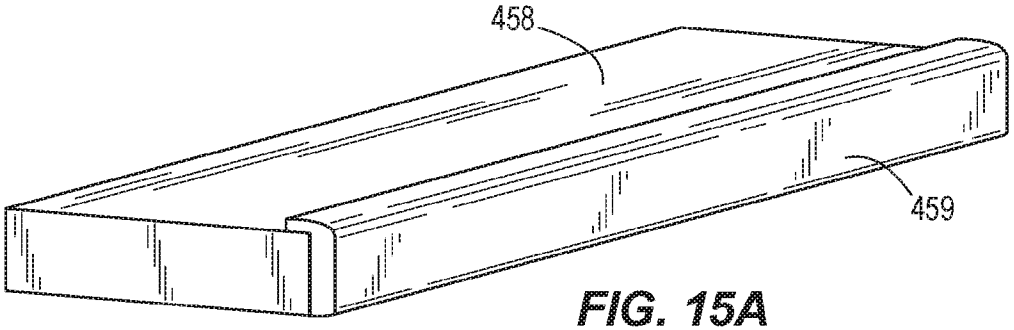
Figure 15B:
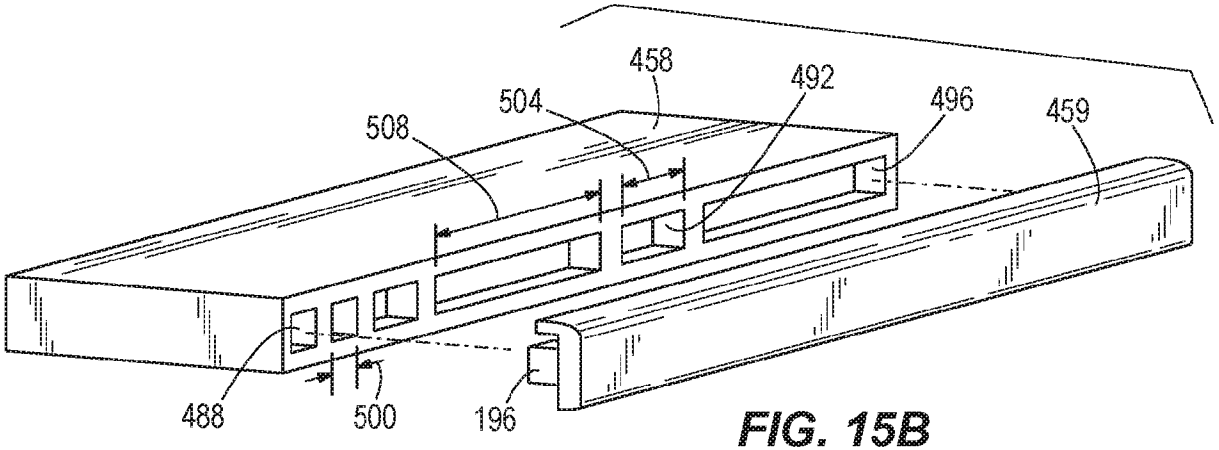

FIGS. 15A-15C illustrate portions of a frame 458 and a carrier 459 with alternative attachment features. In the illustrated embodiment, the carrier 459 includes a first plurality of teeth 460, a second plurality of teeth 464, and a third plurality of teeth 468. The teeth 460, 464, and 468 have unequal widths. Each first tooth 460 has a first width 472. Each second tooth 468 has a second width 476 that is wider than the first width 472. Each third tooth 468 has a third width 480 that is wider than the second width 476. The first teeth 460, the second teeth 464, and the third teeth 468 may be equally spaced. In the illustrated embodiment, a spacing 484 between the teeth 460, 464, 468 is the same as the first width 472. The frame 458 includes a first plurality of apertures 488, a second plurality of apertures 492, and a third plurality of apertures 496. The apertures 488, 492, 496 have unequal widths. Each first aperture 488 has a first width 500. Each second aperture 496 has a second width 504 that is wider than the first width 500. Each third aperture 496 has a third width 508 that is wider than the second width 504. The first apertures 488, the second apertures 492, and the third apertures 496 are configured to receive the first teeth 460, the second teeth 464, and the third teeth 468, respectively.

Figure 16B:
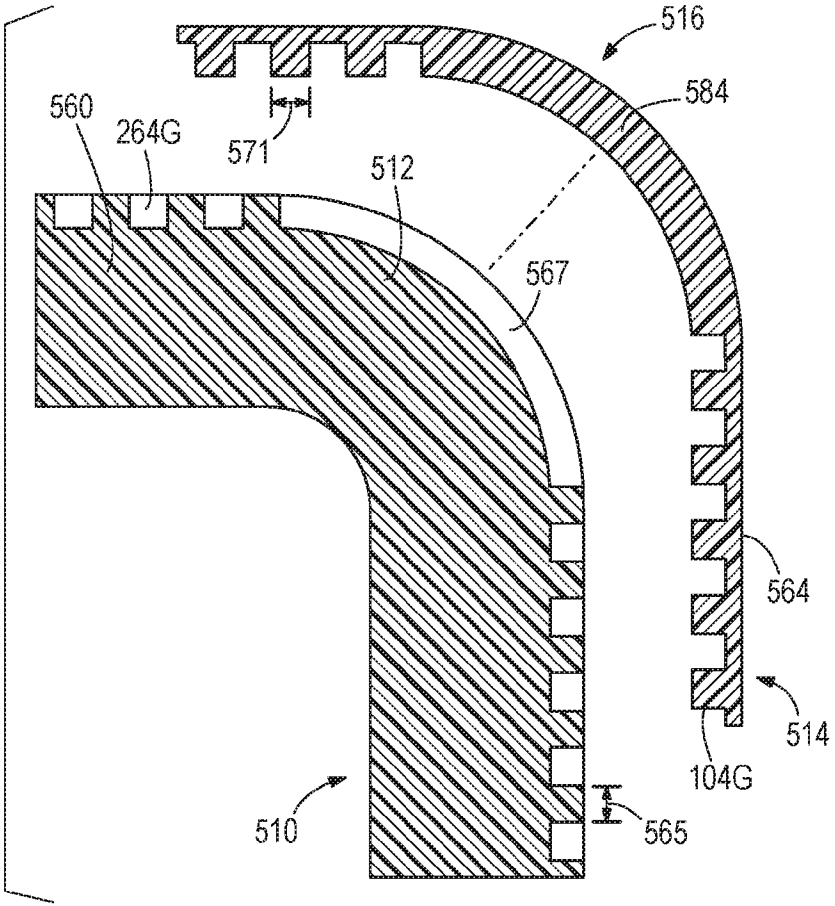
FIGS. 16A-16B show a curved carrier and a curved frame according to some embodiments of the present invention.
Figure 16A:
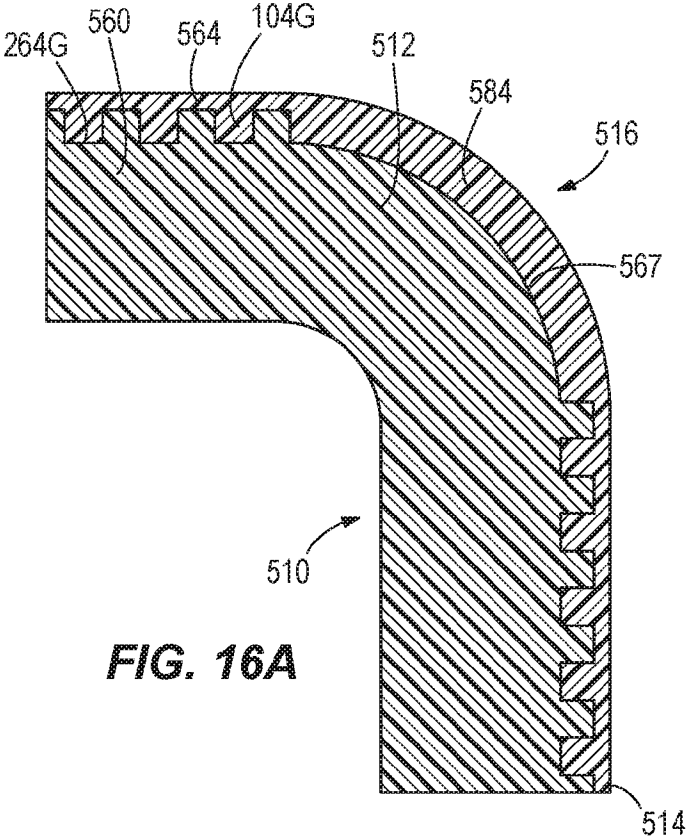

FIGS. 16A-16B illustrate a frame 510 that includes a curved portion 512 and a carrier 514 that includes a curved portion 516. The frame 510 includes a straight portion 559 that has a plurality of evenly spaced apertures 264G of equal width. The curved portion 512 of the frame 510 has a single elongated aperture 567. The carrier 516 includes a straight portion 563 that has evenly spaced teeth 104G of equal width. A spacing 565 between the apertures 264G is approximately equal to the width 571 of the teeth 104G. The curved portion 516 of the carrier 514 includes a single elongated tooth 584. The single elongated aperture 567 at the curved portion 512 of the frame 510 and the single elongated tooth 584 at the curved portion 516 of the carrier 514 may ease manufacturing of the frame 510 and the carrier 514 and assembly of the seating structures 10A, 10B.

Figure 17:
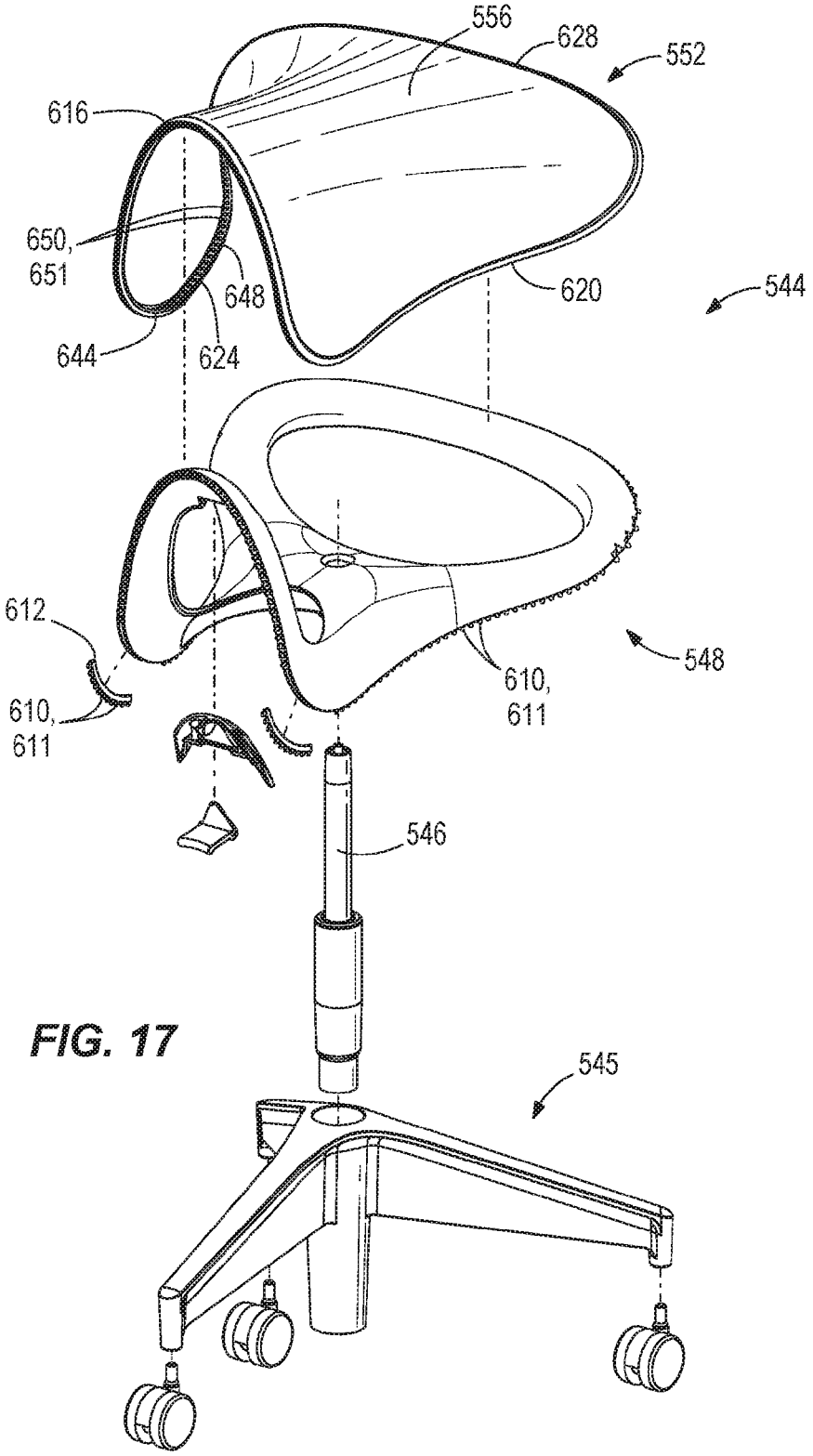
FIG. 17 is an exploded view of a stool according to some embodiments of the present invention.

FIG. 17 illustrates a seating structure 544 embodying the present invention. The illustrated seating structure 544 is a saddle-shaped stool. The stool includes a base 545, a support column 546, a frame 548, a carrier 552, and a suspension material 556. The frame 548, the carrier 552, and the suspension material 556 of the seating structure 544 are configured to form a stool with a relatively high, narrow front and a relatively short, wide back.

Figure 18A:
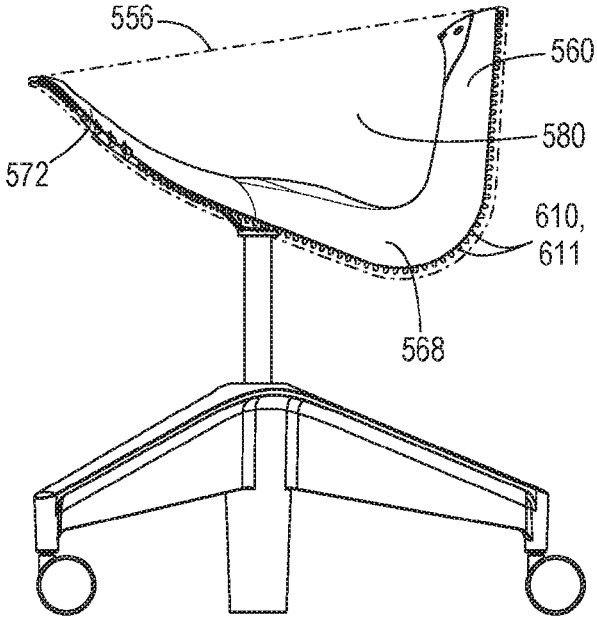
FIG. 18A-18C are views of the stool of FIG. 17.
Figure 18B:
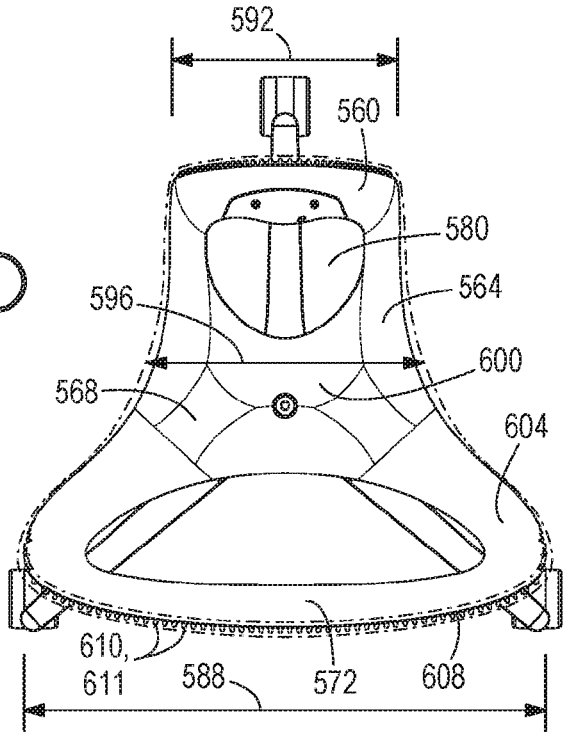

As shown in FIG. 18B, the frame 548 includes a front portion 560, a first side portion 564, a second side portion 568, and a rear portion 572. The front portion 560 extends in a vertical direction and may be substantially arch-shaped. The front portion 560 is spaced from the rear potion 523 and defines an opening 580 therebetween. The first side portion 564 and the second side portion 568 are spaced apart and substantially perpendicular to the front portion 560 and the rear portion 572. In the illustrated embodiment, the front portion 560, the first side portion 564, the second side portion 568, and the rear portion 572 are joined together to form a closed loop or ring.

Figure 18C:
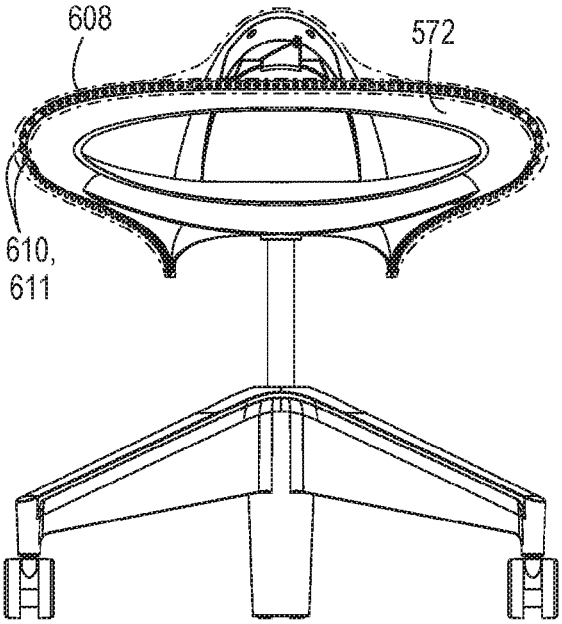

As shown in FIGS. 18B-18C, the rear portion 572 has an extended width 588 that is wider than a width 592 of the front portion 560. The first side portion 564 and the second side portion 568 are shaped so that a width 596 of the opening 580 increases from the front portion 560 to the rear portion 572. A cross portion 600 is positioned between the first side portion 564 and the second side portion 568. The support column 546 is attached to the cross portion 600. In the illustrated embodiment, the first side portion 564 and the second side portion 568 have a curved shape. The front portion 560 has a height greater than a height of the first side portion 564 and the second side portion 568.

The frame 548 includes a support surface 604 and an outer periphery 608. The outer periphery 608 includes a plurality of outwardly extending first attachment features 610. In the illustrated embodiment, the first attachment features 610 are teeth 611. In other embodiments, the first attachment features 610 may be apertures. In the illustrated embodiment, some of the first attachment features 610 are integrally formed with the frame 548. In the embodiment illustrated in FIG. 17, the frame 548 also includes separate insert members 612 that include first attachment features 610.

As shown in FIG. 17, the carrier 552 includes a front portion 616, a first side portion 620, a second side portion 624, and a rear portion 628. The front portion 616 is spaced from the rear potion 628. The first side portion 620 and the second side portion 624 are spaced apart along and substantially perpendicular to the front portion 616 and the rear portion 628. The front portion 616, the first side portion 620, the second side portion 624, and the rear portion 628 are joined together to form a continuous loop or a ring.

The carrier 552 includes a support surface 644 and an inner periphery 648. A plurality of second attachment features 650 extends inwardly from the inner periphery 648. In the illustrated embodiment, the second attachment features 650 are apertures 651. In other embodiments, the second attachment features 650 may be teeth. The apertures 651 of the carrier 552 receive the teeth 611 of the frame 548 to connect the carrier 552 to the frame 548.

The suspension material 556 is coupled to the carrier 552. In the illustrated embodiment, the suspension material 556 is molded into the carrier 552. In alternative embodiments, the suspension material 556 may be attached by the carrier 552 using other suitable coupling means. The suspension material 556 may be made of a woven or knit material, such as elastomeric materials, fabrics, or molded polymeric materials.

When the carrier 552 is connected to the frame 548 by engaging the plurality of first attachment features 102A, 102B with the plurality of second attachment features 262A, 262B, the suspension material 556 is stretched over the opening 580 of the frame 548. As shown in FIG. 17, the suspension material 556 forms a saddle shape when the carrier 552 is attached to the frame 548. The front portion 560 of the frame 548 defines a "horn" portion of the saddle, the rear portion 572 of the frame 548 forms a raised rear support portion, and the two curved side portions 564, 568 are configured to engage the user's thighs. In some embodiments, the carrier 552 may include a plurality of ribs (similar to the ribs 360A, 360B shown in FIG. 10C) positioned along portions of the carrier 552 that may experience point loading, such as along the first and second side portions 564, 568.

FIGS. 19A-19E show a mold tool 656 that is used to form a carrier (such as any of the carriers described above) with an in-molded edge of suspension material. The mold tool 656 includes a first mold component 660 and a second mold component 664. The first mold component 660 and the second mold component 664 define a cavity 668 therebetween. The suspension material is captured between the first mold component 660 and the second mold component 664 so that the edge of the suspension material is disposed within the cavity 668. In embodiments in which the second attachment features 262A, 262B are apertures 264A, 264B, the first mold component 660 includes features 672 (e.g., teeth 672' and protrusion 672") defining the apertures 264A, 264B, channel 304A, 304B, upper surface portion 308A, 308B, and upper lip 280A, 280B of the carrier. In some embodiments, the features 672 are on a removable insert 676 so that the same mold tool 656 can be used to mold different configurations of the carrier 30A, 30B. The second mold component 664 has a wall 680 that abuts an end 684 of the features 672 of the first mold component 660, thereby forming and defining the through openings or recesses in the carrier.

When forming the carrier 30A, 30B, the edge 356A, 356B of the suspension material 34A, 34B is positioned within the mold 656, as shown in FIG. 19B. The first mold component 660 and the second mold component 664 are closed so that the first mold component 660 and the second mold component 664 are vertically stacked one over the other, with the edge 356A, 356B positioned therebetween. Liquefied carrier material is introduced into the cavity 668 through a passageway 688 defined in the first mold component 660, for example, by injection molding. The liquefied carrier material is allowed to harden around the edge 356A, 356B of the suspension material 34A, 34B disposed within the cavity 668 (FIG. 19C). After the liquefied carrier material has hardened, the first mold component 660 is opened relative to the second mold component 664 in a direction substantially perpendicular to the teeth 672 of the first mold component 660 (e.g., in a vertical direction) to retain the carrier 30A, 30B on the first mold component 660 (FIG. 19D). A force or load is supplied to the suspension material 34A, 34B to demold or remove the carrier 30A, 30B from the first mold component 660 (FIG. 19E).

Referring back to FIGS. 1A-2B, to attach the carrier 30A, 30B to the frame 26A, 26B, a section of the second attachment features 262A, 262B of the carrier 30A, 30B is aligned with a section of the first attachment features 102A, 102B of the frame 26A, 26B, for example, by aligning one of the plurality of outwardly extending teeth 104A, 104B with one of the apertures 264A, 264B. Next, the aperture 264A, 264B in the carrier 30A, 30B is pushed along the length 208A, 208B of the tooth 104A, 104B so that the distal end 204A, 204B of the tooth 104A, 104B is disposed between two of the posts 314A, 314B and lies flush along the channel 304A, 304B. The plurality of teeth 104A, 104B are then successively engaged with the plurality of apertures 264A, 264B until all of the teeth 104A, 104B are received in one of the apertures 264A, 264B.

Figure 20:
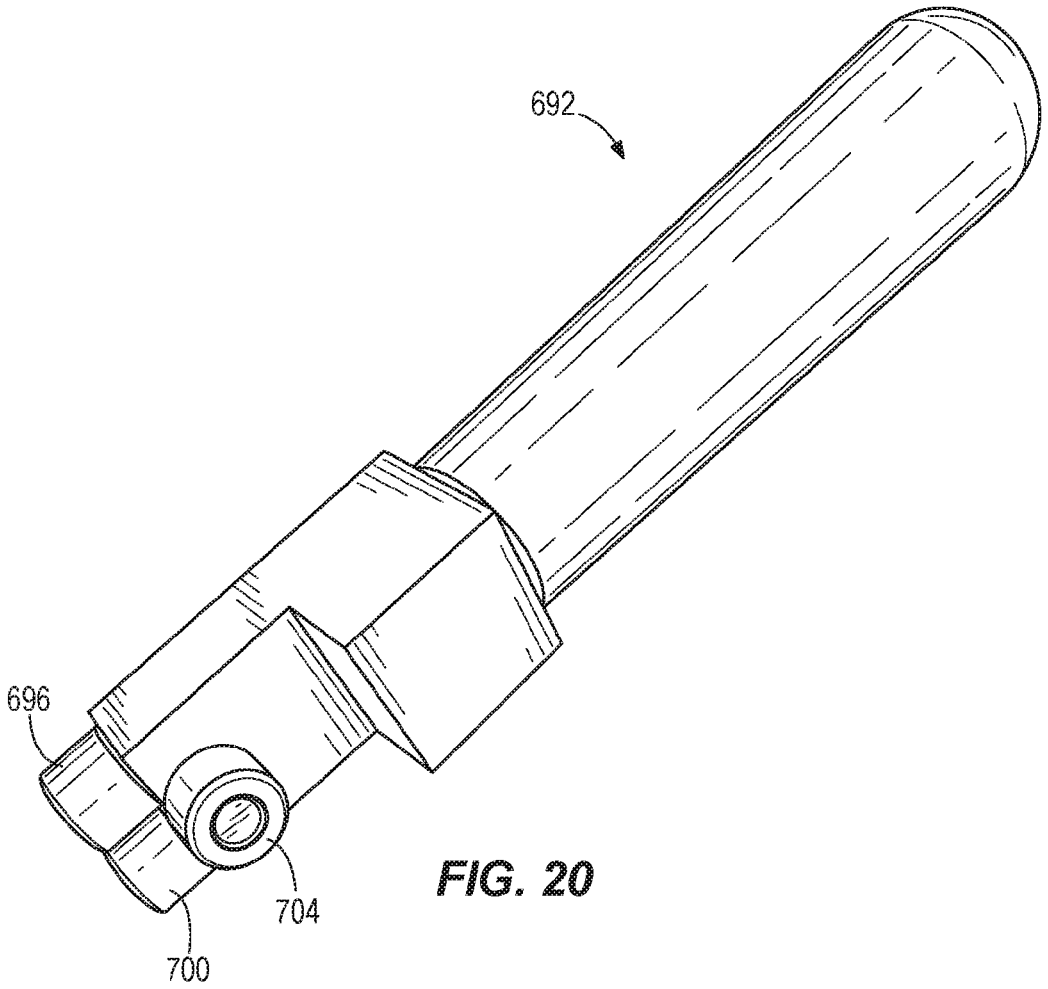
FIG. 20 is a perspective view of a tool used to attach a carrier to a frame.

In embodiments in which the apertures 264A, 264B are through openings, this attachment process is fully visible and may be controlled in a tooth-by-tooth manner. A tool 692 (FIG. 20) including rollers 696, 700, 704 is moved around the periphery of the carrier 30A, 30B to secure the carrier 30A, 30B to the frame 26A, 26B. The rollers 696, 700 of the tool 692 are pressed against the carrier 30A, 30B and rolled along the periphery thereof to connect the carrier 30A, 30B to the frame 26A, 26B. The roller 704 rides within the channel 304A, 304B defined between the upper lip 280A, 280B and the lower lip 286A, 286B of the carrier 30A, 30B, which acts as a track for the tool 692. Once the carrier 30A, 30B is attached to the frame 26A, 26B, the suspension material 34A, 34B is held in tension across the opening 98A, 98B defined by the frame 26A, 26B.

Various features and advantages of the invention are set forth in the following claims.

What is claimed is:

1. A seating structure comprising:

a frame including first and second side frame members spaced apart in a first direction and defining an opening therebetween, the first and second side frame members each having an inner portion facing toward the opening and an outer portion opposite from the inner portion and facing away from the opening, the outer portion including a plurality of first attachment features facing outwardly away from the first and second side frame members in the first direction;

a carrier including first and second side carrier members, the first and second side carrier members each including a plurality of second attachment features facing toward the first and second side frame members in the first direction, the plurality of second attachment features engaging the plurality of first attachment features to attach the carrier to the frame; and a suspension material attached to the carrier and extending over the opening in the frame.

2. The seating structure of claim 1, wherein the frame includes first and second cross frame members spanning between and connected to the first and second side frame members, the first and second cross frame members spaced apart in a second direction transverse to the first direction, and wherein the carrier is a continuous ring formed by the first and second side carrier members and first and second cross carrier members spanning between and connected to the first and second side carrier members, the first and second cross carrier members spaced apart in the second direction transverse to the first direction.

3. The seating structure of claim 2, wherein the first and second cross frame members each have an inner portion facing toward the opening and an outer portion facing away from the opening, each outer portion also including the plurality of first attachment features facing outwardly away from the first and second cross frame members in the first direction, and wherein the first and second cross carrier members each also include the plurality of second attachment features facing toward the first and second cross frame members in the first direction.

4. The seating structure of claim 1, wherein the plurality of first attachment features includes teeth, and the plurality of second attachment features includes apertures that receive the teeth.

5. The seating structure of claim 4, wherein the apertures define through-openings in the first and second side carrier members so that the teeth are visible through the apertures on a side of the carrier facing outwardly away from the opening.

6. The seating structure of claim 5, wherein the carrier includes an upper portion, a lower portion, and a plurality of spaced apart posts extending between the upper portion and the lower portion, the plurality of spaced apart posts defining the apertures.

7. The seating structure of claim 6, wherein each of the first and second side carrier members includes spaced apart upper and lower lips defining an outwardly opening channel therebetween, the channel facing away from the opening.

8. The seating structure of claim 7, wherein each upper lip extends inwardly and overlies at least a portion of the suspension material.

9. The seating structure of claim 1, wherein the carrier includes an uppermost surface that is curved downwardly from an inner section proximate the outer portion of the frame to an outer section spaced outwardly from the inner section.

10. The seating structure of claim 1, further comprising:

a base;

a support column extending vertically from the base; and a tilt mechanism coupled to an end of the support column opposite the base, the tilt mechanism supporting the frame above the base.

11. The seating structure of claim 1, wherein the frame defines a seat or a backrest, and wherein the suspension material forms a seating surface or a backrest surface.

12. The seating structure of claim 1, wherein the frame defines both a seat and a backrest, and wherein the suspension material forms a continuous seating surface and backrest surface.

13. The seating structure of claim 1, wherein the frame, the carrier, and the suspension material form an armrest.

14. The seating structure of claim 1, wherein the suspension material is molded into the carrier.

15. A seating structure comprising:

a frame including first and second cross frame members spaced apart in a first direction and defining an opening therebetween, the first and second cross frame members each having an inner portion facing toward the opening, an outer portion facing away from the opening, and an upper surface disposed between the inner portion and the outer portion;

a carrier including first and second cross carrier members spaced apart in the first direction, the first and second cross carrier members coupled to the frame, the first cross carrier member having an upper lip overlying the upper surface of the first cross frame member and a plurality of ribs extending from the upper lip, the plurality of ribs engaging the upper surface of the first cross frame member and supporting the upper lip above the upper surface of the first cross frame member; and a suspension material embedded in the upper lip of the carrier;

wherein the upper lip covers a first surface of the suspension material, and the plurality of ribs extends outwardly from a second surface of the suspension material, and wherein the plurality of ribs includes discrete elements that are deflectable independently of each other.

16. The seating structure of claim 15, wherein the carrier defines a line of tension defined between a first side of the carrier and an opposite second side of the carrier, and wherein a portion of each rib extends above the line of tension.

17. The seating structure of claim 16, wherein the plurality of ribs supports at least a portion of the suspension material above the line of tension.

18. The seating structure of claim 15, further comprising a seat and a backrest, wherein the frame, the carrier, and the suspension material define at least the seat, and wherein the first cross frame member forms a forward edge of the seat opposite from the backrest.

19. A method of assembling a seating structure, the method comprising:

providing a frame including first and second side frame members spaced apart in a first direction and defining an opening therebetween, the first and second side frame members each having an inner portion facing toward the opening and an outer portion opposite from the inner portion and facing away from the opening, each outer portion including a plurality of first attachment features facing outwardly away from the first and second frame members in the first direction;

providing a carrier including first and second side carrier members, the side carrier members each including a plurality of second attachment features facing toward the first and second side frame members in the first direction;

attaching a suspension material to the carrier; and engaging the plurality of second attachment features with the plurality of first attachment features to attach the carrier to the frame so the suspension material extends over the opening in the frame.

20. The method of claim 19, wherein providing the frame includes providing first and second cross frame members spanning between and connected to the first and second side frame members, the first and second cross frame members spaced apart in a second direction transverse to the first direction, and wherein providing the carrier includes providing a continuous ring formed by the first and second side carrier members and first and second cross carrier members spanning between and connected to the first and second side carrier members, the first and second cross carrier members spaced apart in the second direction transverse to the first direction.

21. The method of claim 19, wherein the plurality of first attachment features includes teeth and the plurality of second attachment features include apertures, and wherein engaging the plurality of second attachment features with the plurality of first attachment features includes successively inserting the teeth into the apertures.

22. The method of claim 19, further comprising moving a tool around a perimeter of the carrier to press the plurality of second attachment features into engagement with the plurality of first attachment features.

23. The method of claim 22, wherein the carrier defines an outwardly opening channel formed between an upper lip and a lower lip, and wherein moving the tool around the perimeter of the carrier includes moving the tool within the channel.

24. The method of claim 19, further comprising defining a seat or a backrest with the frame, and forming a seating surface or a backrest surface with the suspension material.

25. The method of claim 19, further comprising defining both a seat and a backrest with the frame, and forming a continuous seating surface and backrest surface with the suspension material.

26. The method of claim 19, further comprising defining an armrest with the frame, and forming an armrest surface with the suspension material.

27. The method of claim 19, wherein attaching the suspension material to the carrier includes molding the suspension material into the carrier.

* * * * *